US007740111B2

(12) United States Patent
Yoshikawa et al.

(10) Patent No.: US 7,740,111 B2
(45) Date of Patent: Jun. 22, 2010

(54) ELEVATOR GROUP SUPERVISORY CONTROL SYSTEM WITH ROUTE PREPARATION SECTION

(75) Inventors: Toshifumi Yoshikawa, Hitachinaka (JP); Satoru Toriyabe, Hitachinaka (JP); Takamichi Hoshino, Hitachinaka (JP); Atsuya Fujino, Hitachinaka (JP); Shunichi Tanae, Hitachinaka (JP); Hiromi Inaba, Hitachinaka (JP); Kenji Yoneda, Hitachinaka (JP); Toru Yamaguchi, Higashi Hiroshima (JP); Ryo Okabe, Hitachinaka (JP)

(73) Assignees: Hitachi, Ltd., Tokyo (JP); Hitachi Mito Engineering Co., Ltd., Hitachinaka-shi (JP)

( * ) Notice: Subject to any disclaimer, the term of this patent is extended or adjusted under 35 U.S.C. 154(b) by 0 days.

(21) Appl. No.: 12/507,500

(22) Filed: Jul. 22, 2009

(65) Prior Publication Data

US 2009/0283368 A1 Nov. 19, 2009

Related U.S. Application Data

(63) Continuation of application No. 12/185,984, filed on Aug. 5, 2008, which is a continuation of application No. 11/210,903, filed on Aug. 25, 2005, now Pat. No. 7,426,982.

(30) Foreign Application Priority Data

Mar. 23, 2005 (JP) ..... 2005-082906

(51) Int. Cl.
*B66B 1/16* (2006.01)

(52) U.S. Cl. ..... 187/382; 187/247

(58) Field of Classification Search ..... 187/380–388, 187/247
See application file for complete search history.

(56) References Cited

U.S. PATENT DOCUMENTS

| | | | | |
|---|---|---|---|---|
| 4,982,817 | A | 1/1991 | Tsuji | |
| 6,145,631 | A * | 11/2000 | Hikita et al. | 187/383 |
| 6,293,368 | B1 | 9/2001 | Ylinen et al. | |
| 6,672,431 | B2 | 1/2004 | Brand et al. | |
| 6,913,117 | B2 | 7/2005 | Tyni et al. | |
| 7,014,015 | B2 * | 3/2006 | Nikovski et al. | 187/382 |
| 7,275,623 | B2 | 10/2007 | Tyni et al. | |
| 7,426,982 | B2 * | 9/2008 | Yoshikawa et al. | 187/382 |
| 7,562,746 | B2 * | 7/2009 | Yoshikawa et al. | 187/382 |
| 2004/0060776 | A1 | 4/2004 | Tyni et al. | |
| 2006/0249335 | A1 | 11/2006 | Yoshikawa et al. | |

FOREIGN PATENT DOCUMENTS

GB 2264571 9/1993

(Continued)

*Primary Examiner*—Jonathan Salata
(74) *Attorney, Agent, or Firm*—Crowell & Moring LLP

(57) ABSTRACT

An elevator group control system for controlling multiple elevators cars each of which serves a plurality of floors includes a route preparation section which, at a time of assigning a hall call to one of the elevator cars, calculates a future trajectory for each of the elevator cars. The future trajectory for each elevator is for a case in which the hall call is assigned to the elevator car. A selecting unit which determines a selected one of the elevator cars to which the hall call is to be assigned using the calculated future trajectories.

5 Claims, 24 Drawing Sheets

BASIC CONCEPT 1 OF TARGET ROUTE-BASED CONTROL

FOREIGN PATENT DOCUMENTS

| | | |
|---|---|---|
| JP | 5115291 | 5/1976 |
| JP | 211008 | 4/1990 |
| JP | 5238653 | 9/1993 |
| JP | 7061722 | 3/1995 |
| JP | 8175769 | 7/1996 |

* cited by examiner

PREDICTED ROUTE PREPARATION SECTION WITH PROVISIONAL HALL CALL ASSIGNMENT

PREDICTED ROUTE PREPARATION SECTION DURING REGULAR PROCESSING (FOR TARGET ROUTE UPDATE CHECK)

BASIC CONCEPT 1 OF TARGET ROUTE-BASED CONTROL

BASIC CONCEPT 2 OF TARGET ROUTE-BASED CONTROL

FIG.10A TARGET ROUTE CONTROL
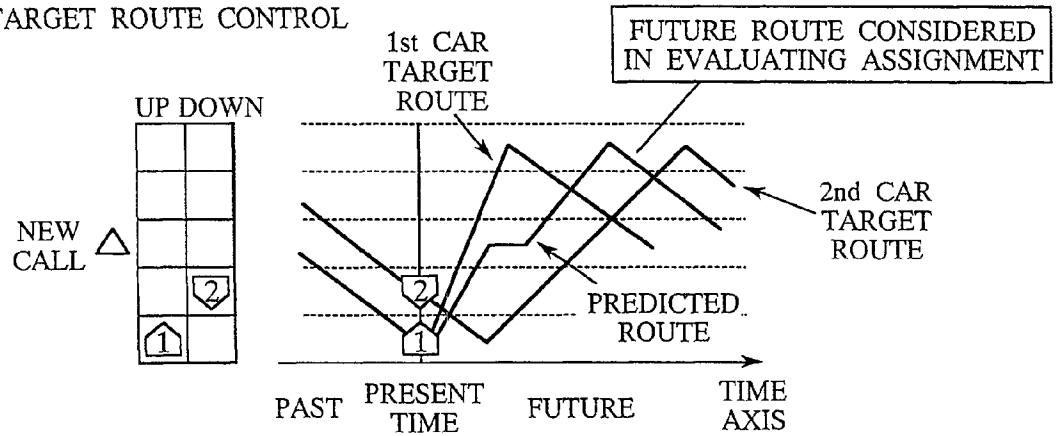
FIG.10B CONVENTIONAL CONTROL
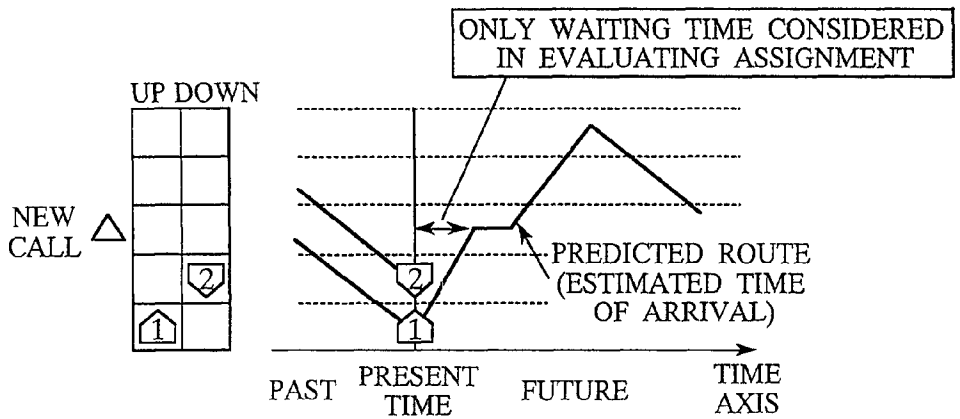

CONCEPT OF ADJUSTMENT AREA FOR TARGET ROUTE

CONCEPT OF ADJUSTMENT AREA-USED TARGET ROUTE CONTROL

FIG.14A TARGET ROUTE PROFILE BEFORE ADJUSTED (2nd CAR)
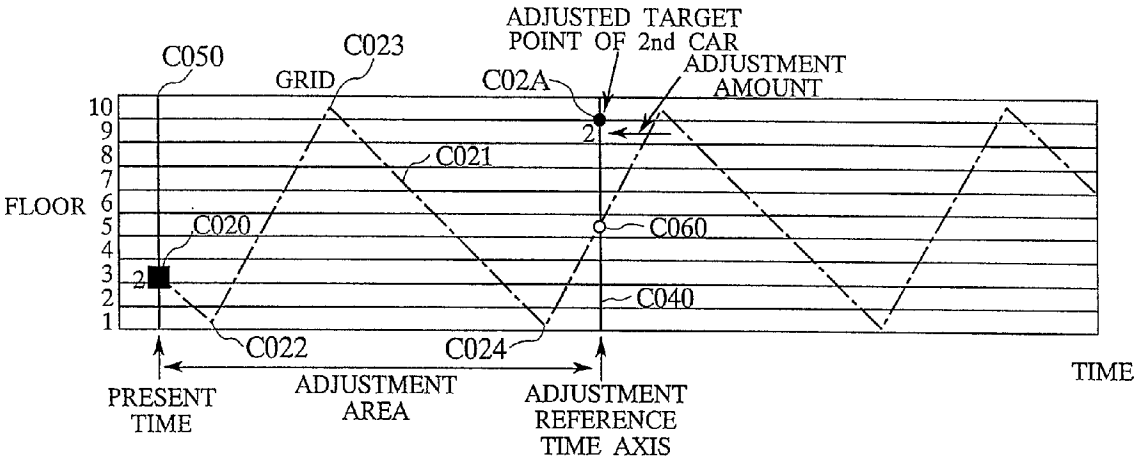
FIG.14B TARGET ROUTE PROFILE AFTER ADJUSTED (2nd CAR)
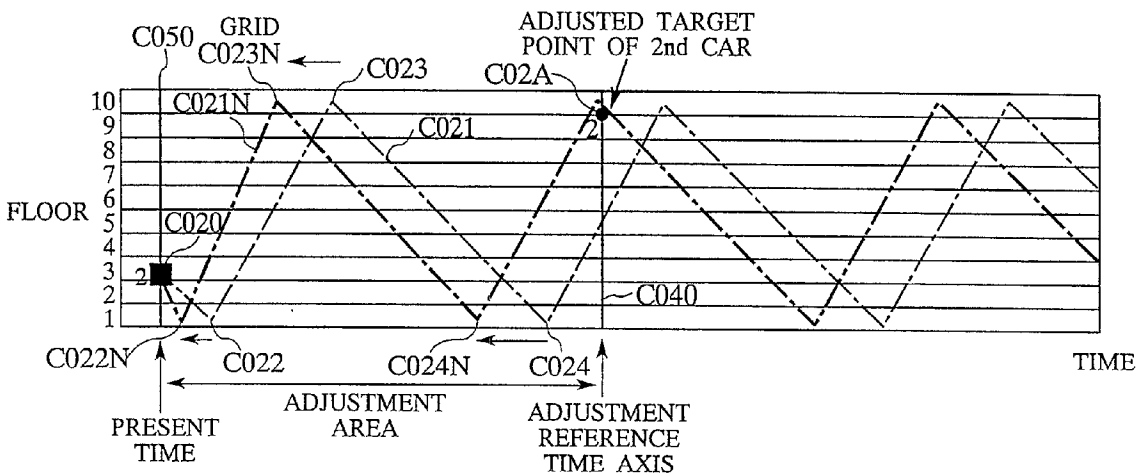

DEFINITION OF TEMPORAL PHASE VALUE tp

FEW ASSIGNMENTS (STOPS)

MANY ASSIGNMENTS (STOPS)

TARGET ROUTE CONTROL DETERMINES ASSIGNMENT SO AS TO DECREASE THE ASSIGNMENT.
THEREFORE, MANY CALLS ARE ASSIGNED TO THE SECOND CAR AS SHOWN IN FIG.17B CONSEQUENTLY, THE ACTUAL ROUTE COMES CLOSER TO THE TARGET ROUTE.

METHOD OF CALCULATING INTER-ROUTE DISTANCE BETWEEN TARGET ROUTE AND PREDICTED ROUTE

ELEVATOR GROUP SUPERVISORY CONTROL SYSTEM WITH ROUTE PREPARATION SECTION

CROSS REFERENCE TO RELATED APPLICATION

This application is a continuing application of U.S. application Ser. No. 12/185,984, filed Aug. 5, 2008, which is a continuing application of U.S. application Ser. No. 11/210,903, filed Aug. 25, 2005, which claims priority under 35 U.S.C. §119 to Japanese Patent Application No. 2005-082906, filed Mar. 23, 2005, the entire disclosure of which are herein expressly incorporated by reference.

BACKGROUND OF THE INVENTION

The present invention relates to an elevator group supervisory control system and in particular to control of elevator assignment to generated hall calls.

An elevator group supervisory control system treats multiple elevator cages as one group to provide more efficient transport service to users. Specifically, four to eight elevator cages are typically controlled as one group. If a hall call occurs at a floor, the most appropriate one is selected from this group and assigned to the hall call.

Assignment control based on an assignment evaluation function of waiting time, which constitutes the basic assignment control principle of existing group supervisory control systems, was developed around 1980 when microcomputers were introduced. In this method, yet-to-be served hall calls are kept under management. If a new hall call occurs, the time for which the new hall call would wait until served is calculated for each cage according to the predicted waiting time of each yet-to-be served hall call. Consequently, the new hall call is assigned to either a cage that requires the shortest waiting time or a cage that is not to serve a hall call which has long been pendent. This control principle, determining call assignment according to an evaluation function of predicted waiting time, provided an epoch-making control method in those days and has been inherited to the present elevator makers for group supervisory control. However, this control has the following two problems:

1) Optimum cage assignment is determined based only on the yet-to-be served hall calls. Influence on future assignments is not taken into consideration.
2) Assignment is made to a cage which minimize the evaluation function where no cage-to-cage spatial relation is considered. There is no concept of cooperation among the cages.

To solve these problems with the aforementioned assignment method using an evaluation function of predicted waiting time, a variety of control methods have so far been proposed. To be brief, their basic policies are to control the respective cages so as to arrange them at temporally equal intervals. If the respective cages are not evenly distributed, that is, some is temporally distant from another, a hall call occurring between them is likely to wait long until served. If the respective cages are arranged at temporally equal intervals, it is possible to prevent long waits. The conventional control methods which are aimed at temporally equal interval arrangement are listed below.

1) Equal interval-prioritized zone control (disclosed in JP-A-1-226676)

2) Equal interval-prioritized zone/Inhibited zone control (disclosed in JP-A-7-117941)

In each of these two methods, a priority zone consisting of some served floors and an inhibited zone of other served floors are set to each car. If a new hall call occurs in the priority zone of a cage, the evaluation value is manipulated so as to raise the probability of the hall call being assigned to the cage. In the case of a new hall call in the inhibited zone, the evaluation value is manipulated so as to lower the probability of assignment. This intends to make the respective cages closer to a temporally equal interval state.

3) Temporally equal interval-considered assignment-evaluated control (disclosed in JP-B-7-72059)

The position of each cage at a future point of time is predicted. Accordingly, cage-to-cage temporal intervals at that time are predicted. The assignment limiting evaluation value is calculated from this predicted cage-to-cage intervals. This evaluation value is used to control assignments to prevent many cages from being assigned to specific floors. This intends to consequently make the cage-to-cage intervals more temporally even.

4) Assignment correction by making service availability time distribution uniform (disclosed in WO98/45204)

This basic concept is similar to the method 3). The arrangement of the respective cages at a future point of time is predicted. From the predicted cage arrangement, the fastest time of arrival at each floor is calculated as the service availability time. Further, the service availability time distribution is calculated. The hall call assignment evaluation values are corrected so as to make the service availability time distribution uniform. This intends to consequently make the service availability time constant not depending on the floor.

5) Position evaluation value-used assignment method (JP-A-2000-118890)

In this method, a position evaluation value to prevent cages from clustering is calculated for each cage. Assignment to a hall call is determined using a position evaluation-included assignment evaluation value. The position evaluation value of a cage is calculated based on the relation between its absolute position and the average absolute position of the other cages when the hall call is generated. This method also intends to evenly arrange the respective cages.

However, the above-listed prior art techniques do not substantially solve the problem of arranging the cages evenly to attain equal interval condition. Since cage-to-cage intervals/positioning are evaluated only at one point of time, the aforementioned prior art techniques are difficult to stably keep the respective elevator cage in temporally equal interval state over a long period of time.

SUMMARY OF THE INVENTION

Accordingly, it is an object of the present invention to allow cages to settle in temporally equal interval state over a long period of time by solving the problems of the prior art control techniques.

To attain the above-mentioned object, the present invention provides a system comprising: reference route generating means which, for each elevator, generates a reference route which the elevator should follow with respect to the time axis and position axis; and assignment means which selects an elevator for assignment to a generated hall call so as to make the actual trajectory of each elevator closer to the reference route of the elevator.

An elevator group supervisory control system according to the present invention allows cages to settle in temporally equal interval condition over a long period of time since reference routes which guides the cages into temporally equal interval condition are generated and car assignment is executed so as to make the respective cages follow their reference routes.

BRIEF DESCRIPTION OF THE DRAWINGS

Other objects and advantages of the invention will become apparent from the following description of embodiments with reference to the accompanying drawings in which:

FIGS. 10A and 10B show the difference between control according to the present invention and conventional control;

FIGS. 14A and 14B show the process of preparing target routes in the first embodiment of the present invention;

DETAILED DESCRIPTION OF THE EMBODIMENTS

A first embodiment of the present invention will be described below with reference to the drawings. FIGS. 1, 2, 4 through 9 and 11 through 15 each concern the first embodiment.

Figure 8:
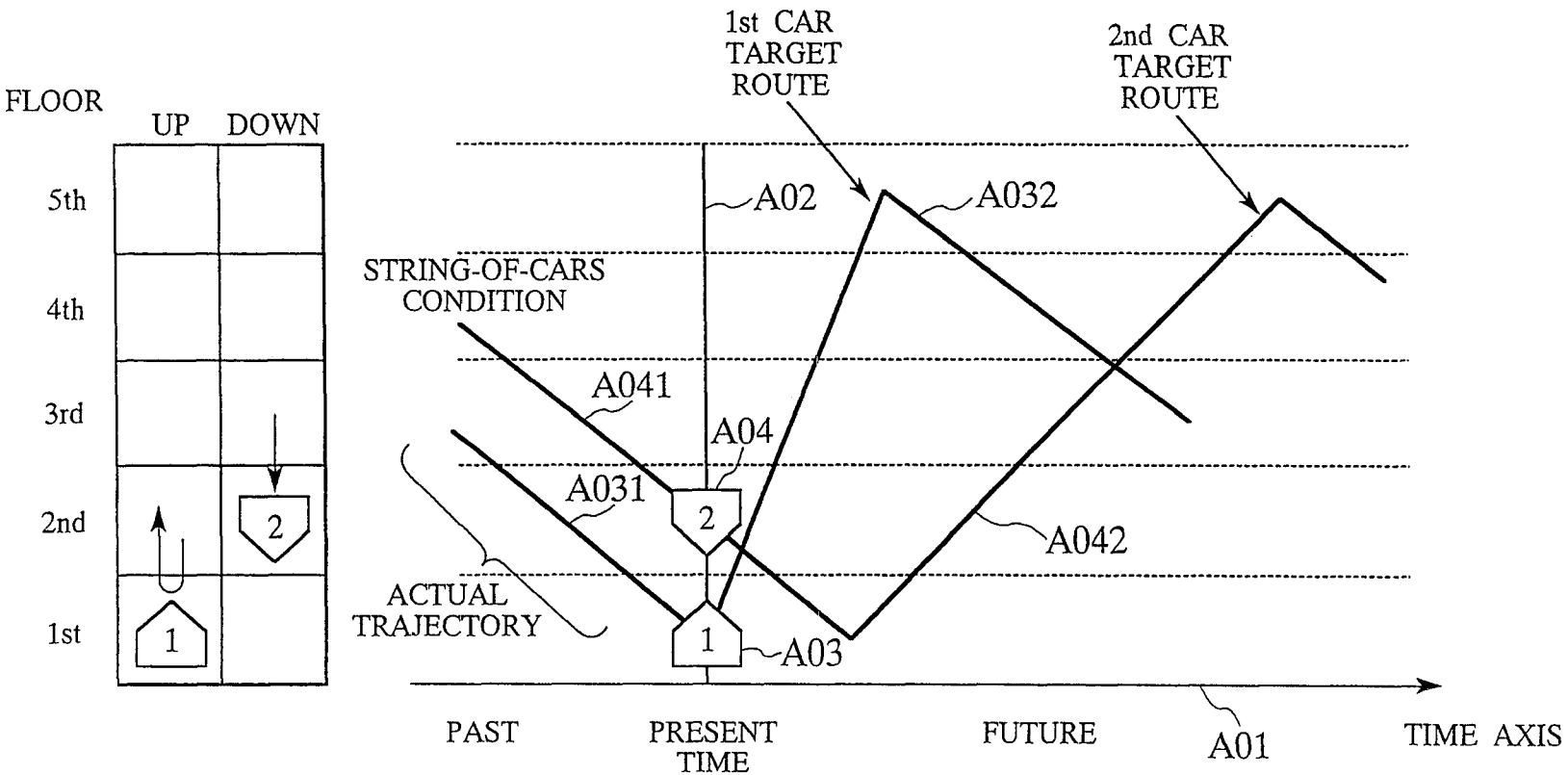
FIG. 8 is a first diagram illustrating the control concept of an elevator group supervisory control system according to the present invention.
Figure 9:
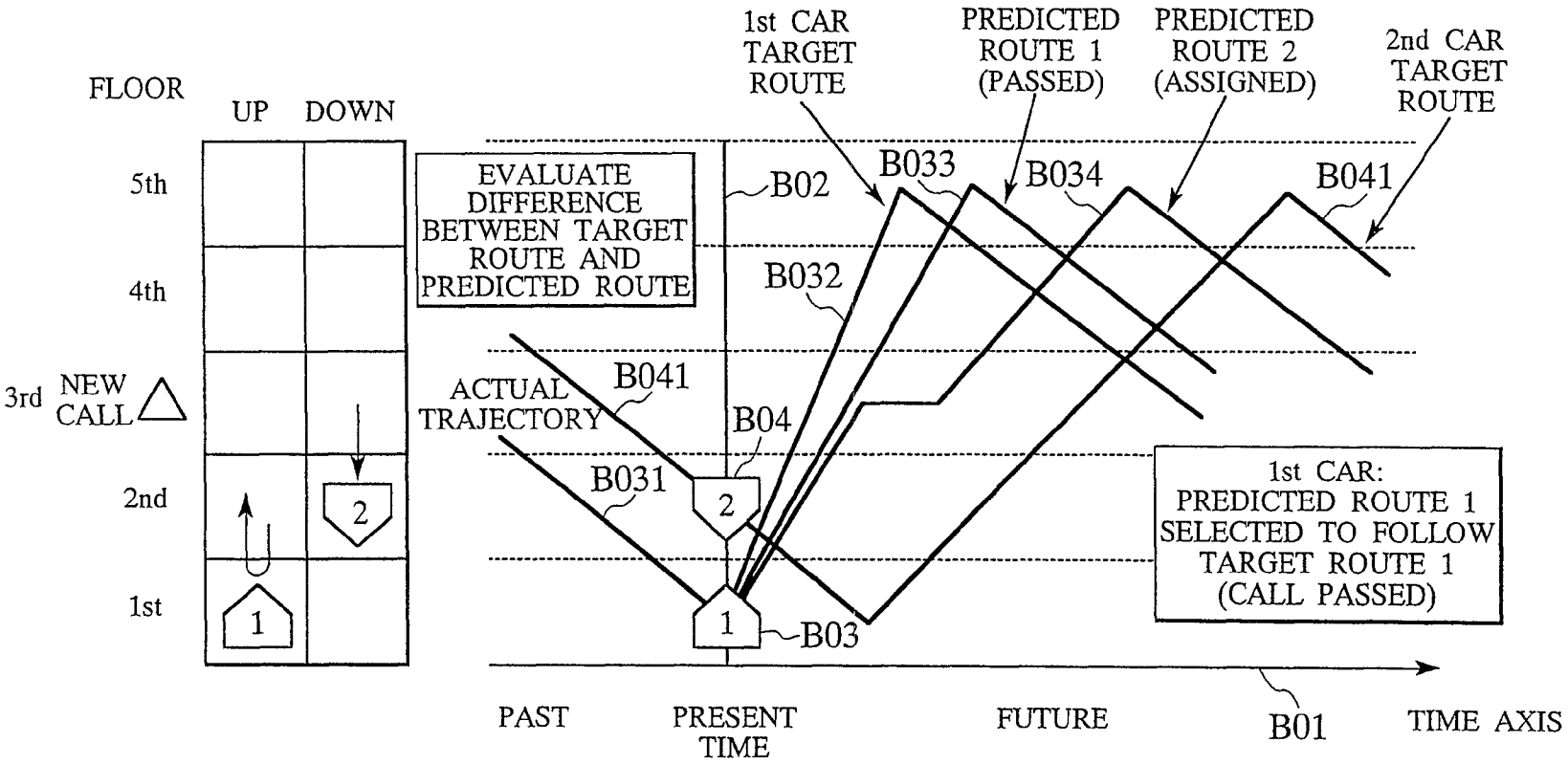
FIG. 9 is a second diagram illustrating the control concept of an elevator group supervisory control system according to the present invention.

Firstly, control images (principles of control) of an elevator group supervisory control system of the present invention is described based on FIGS. 8 and 9. FIG. 8 is an example of a control image concerning the elevator group supervisory control system in accordance with the present invention. Left in FIG. 8, a longitudinal (vertical) section of shafts within a building is conceptually shown with elevator cars moving therein. Shown right in FIG. 8 is a diagram (generally called an operation diagram) which depicts the trajectory of each elevator car with the horizontal axis (A01) representing the time and the vertical axis (A02) representing the vertical position of a given floor in the building. In the example of FIG. 8, the elevator group supervisory control system controls two cars. Left in FIG. 8, the first car (given reference numeral 1) is going up after changing its direction at the first floor while the second car (given reference numeral 2) is going down from the second floor. This situation can be grasped by examining the operation diagram shown right in FIG. 8. To the left of the point representing the present time along the time axis, the first car (A03) and the second car (A04) were descending toward the landings of the first floor and second floor, respectively. That is, the actual trajectory of each car is shown to the left of the present time in the operation diagram of FIG. 8. That is, the actual trajectory of the first car is a trajectory A031 while the actual trajectory of the second car is a trajectory A041.

The present invention concerns the future trajectory of each car to the right of the present time along the time axis in the operation diagram. This represents a "target trajectory" which the car should follow after the present time. Hereinafter, this target trajectory is denoted as a "target route". An elevator group supervisory control system according to the present invention is characterized in that the operation (to be precise, assignment) of each car is controlled so as to follow the target route. Specifically, A032 is the target route of the first car while A042 is the target route of the second car. Introduction of these target routes or target (or reference) trajectories, which the respective cars should be controlled to follow along the time axis, makes the present invention different from the conventional group supervisory control systems.

FIG. 9 depicts how an elevator car is decided to be assigned to a hall call according to the target route. Basically identical to FIG. 8, the left side provides a vertical sectional view of the shafts showing the situation of the elevators while the right side provides an operation diagram. Firstly, assume that a new hall call demanding upward transportation has occurred at the third floor (see the left diagram of FIG. 9). The group supervisory control assigns an appropriate car, the first car (B03) or the second car (B04). Here, give attention to the movement of the first car (B93). The target route of the first car is trajectory B032. The predicted route (a trajectory predicted to be followed after the present time) of the first car is route B033 (predicted route 1) if the new hall call is not assigned or route B034 (predicted route 2) if the new hall call is assigned. Group supervisory control according to the present invention tries to move each car so that its target route is followed.

Accordingly, since predicted route 1, that is, the route predicted to be taken if the hall call is not assigned is nearer to the target route, the hall call is not assigned to the first car. Consequently, the actual trajectory of the first car approximates to the target route.

Although the effect of this control will separately be described, the effect is essentially derived by drawing the target routes so that the respective elevator cars run at temporally equal intervals. As a result of the actual trajectories of the respective cars following the target routes, it is possible in the long run to stably control the respective cars so as to maintain the trajectories of the respective cars at temporally equal intervals.

For example, in the case of FIG. 9, the actual trajectory (B031) of the first car (B03) is close to the actual trajectory (B041) of the second car (B04), that is, they are run in a string-of-cars condition until the present time. At this time, if a new hall call demanding upward transportation, generated at the third floor, is assigned to the second car, the first car (B03) and the second car (B04) will continue to be close to each other in a string-of-cars condition. However, if the first car is controlled so as to distance itself from the second car by following its target route designed to locate the respective cars at temporally equal intervals, that is, if the new hall call is not assigned to the first car (B03), the first car will follow its target route aimed at the temporally equal interval condition.

Based on FIGS. 8 and 9, the following summarizes what characterize the control principles of an elevator group supervisory control system in accordance with the present invention.

As shown in FIG. 8, target routes which the respective cars should follow along the time axis are set.

As shown in FIG. 9, in order that the respective cars follow their target routes, a hall call is assigned to a car which would come closer to its target route if the car serves the hall call based on the result of comparing the target routes with the predicted routes.

Consequently, each car runs so as to follow its target route.

Since the target routes are set so as to locate the trajectories of the respective cars at temporally equal intervals, the respective cars are stably controlled in the long run to keep them in the temporally equal interval condition.

Figure 1:
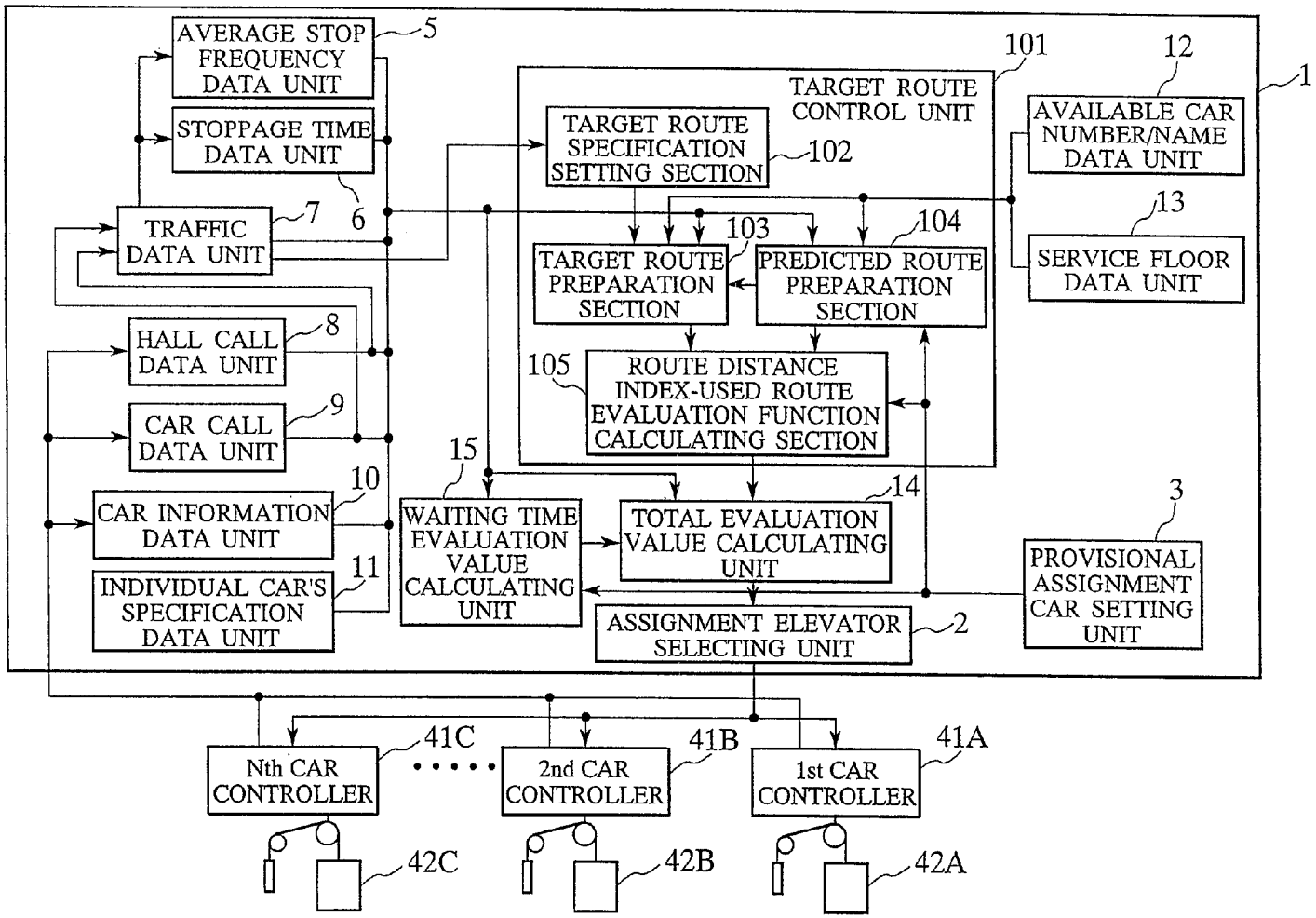
FIG. 1 shows the general control configuration of an elevator group supervisory control system according to an embodiment of the present invention.

By using FIG. 1, the following describes how an elevator group supervisory control system in accordance with the present invention is configured. While FIG. 1 depicts the control system configuration of an elevator group supervisory control system in accordance with the present invention, this control system is implemented on a microcomputer, DSP (Digital Signal Processor), system LSI, computer (personal computer, etc.) or the like. Referring to FIG. 1, the following four components are key components: a target route preparation section 103, a predicted route preparation section 104, a route evaluation function-used route evaluation function calculating section 105, and an assignment elevator selecting unit 2 within a target route control unit 101. Basically, target route-based control as described with FIGS. 8 and 9 is executed by these four components.

The following provides a detailed description of the control configuration of FIG. 1. Firstly, FIG. 1 is largely composed of: a plurality of elevators (42A, 42B and 42C); controllers (41A, 41B and 41C) which respectively control these individual elevators (the first through Nth elevators); and a group supervisory control system 1 which collectively controls these elevators as one group. The controllers (41A, 41B and 41C) associated respectively with the individual elevators or the first through Nth elevators control the positions and velocities of their elevators based on the hall calls assigned to elevators and the car call information derived from the hall calls.

The function of the group supervisory controller 1 is to determine which car is the most appropriate for a generated hall call based on the information regarding each elevator (position, moving direction, already assigned hall call, derived car call, hall call waiting time, etc.) and assign the hall call to the car. This function is described below in detail.

In the target route control unit 101, a target route specification setting section 102 sets specifications for target routes based on the information from a traffic data unit 7. This will be described later in detail. Basically, trajectories that keep the respective elevators at temporally equal intervals are set as these specifications. The traffic data unit 7 outputs the latest information about traffic within the building (statistical information about elevator-used human traffic).

The target route preparation section 103 generates target routes (such as A032 and A042 in FIG. 8) for the respective elevator cars. As input data, this target route preparation uses: hall call information (information about hall calls assigned to the respective cars) obtained from a hall call data unit 8; car call information (information about car calls assigned to the respective cars) obtained from a car call data unit 9; traffic information obtained from the traffic data unit 7; average stop frequencies (for example, how many times an elevator is expected to stop during ascent or descent) obtained from an average stop frequency data unit 5; stoppage time information (for example, average stoppage time per stop) obtained from a stoppage time data unit 6; each elevator car's rated velocity and other specification information obtained from an individual car specification data unit 11; available car count/name information (indicating how many and which cars can be controlled as a group at that time or in that period) obtained from an available car count/name data unit 12; service floor information (information about which floors can be served at that time or in that period) obtained from a service floor data unit 13; and predicted route information obtained from the predicted route preparation section 104. Note that since the average stop frequency and stoppage time of each elevator depends on the current traffic within the building (for example, the elevator is expected to have longer stops at the beginning of office hours), the average stop frequency data unit 5 and the stoppage time data unit 6 are configured to receive traffic information from the traffic data unit 7. By using such detailed information about the traffic in the building and the situation of the elevators, it is possible to set more appropriate target routes. The target route preparation method will be described later in detail.

In the predicted route preparation section 104, predicted routes are prepared for each car. Predicted route 1 (B033) and predicted route 2 (B034) shown in FIG. 9 are specific examples. A predicted route of a car is a predicted trajectory that the car may follow from the present time. Like when target routes are prepared, the predicted route preparation uses the following input data: hall call information obtained from the hall call data unit 8; car call information obtained from the car call data unit 9; traffic information obtained from the traffic data unit 7; average stop frequencies obtained from the average stop frequency data unit 5; stoppage time information obtained from the stoppage time data unit 6; each elevator car's specification information obtained from the individual car specification data unit 11; available car count/name information (indicating how many and which cars can be run at that time or in that period) obtained from the available car count/name data unit 12; service floor information (information about which floors can be served at that time or in that period) obtained from the service floor data unit 13; and provisional assignment information from a provisional assignment car setting unit. In this control system, accurate prediction is one of the important points. This can be realized by using detailed information about the traffic in the building and the condition of the elevators as mentioned above. How to prepare predicted routes will be described later in detail.

In the route distance index-used route evaluation function calculating section 105, 'nearness' between a target route and a predicted route is evaluated for each car by a route distance index-used route evaluation function. In determining which car to assign to a hall call, use of this route evaluation function makes it possible to select an elevator car whose predicted route to be taken by the car if assigned to the hall call is closer to its target route. In the example of FIG. 9, the route distance index is an index to quantify the nearness between the first car's target route (B032) and predicted route (B033 or B034). The route distance index and the route evaluation function will be described later in detail.

A waiting time evaluation value calculating unit 15 calculates an evaluation value for each car based on the time for which a hall call is predicted to wait if assigned to the car. For example, the evaluation value for a car assigned provisionally to a newly generated hall call may directly be the time for which the hall call is predicted to wait. Likewise, the largest of the times for which all hall calls already assigned to the car are respectively predicted to wait may be set as the evaluation value for the car.

In a total evaluation value calculating unit 14, a waiting time evaluation value calculated by the waiting time evaluation value calculating unit 15 is weighted and added to a route evaluation function value calculated by the route distance index-used route evaluation function calculating section 105 to calculate a total evaluation value. Using ΦR(k), ΦW(k), WC and ΦT(k) to respectively denote the route evaluation function value, waiting time evaluation value, weighting factor and total evaluation value, the total evaluation value ΦT(k) is given by the following equation.

$$\Phi T(k)=\Phi W(k)+\Phi R(k)\times WC \quad \text{(A)}$$

Where, k means the car is the k-th car. The weighting factor WC is varied depending on the traffic condition at that time. For example, when the building is deserted (midnight, early morning, etc.), the WC value is made smaller since hall calls do not frequently occur and it is therefore appropriate to give greater importance to the waiting time evaluation value than to the route evaluation value. On the other hand, when the building is crowded, the WC value is made larger since hall calls occur frequently and target route-based control is effective. By using the total evaluation value as given by equation (A), it is possible to change the relation of priority between waiting time-based evaluation and target route-based evaluation for assignment depending on the traffic condition.

Based on the total evaluation values calculated for the respective cars by the total evaluation value calculating unit 14, the assignment elevator selecting unit 2 determines which car is to be assigned to the hall call.

Through the operation of each component of the control configuration described with FIG. 1, it is possible to implement the target route-based control principle described with FIGS. 8 and 9. To be accurate, FIGS. 8 and 9 focus on the operation of target route control unit 101 and the operation of the waiting time evaluation value calculating unit 15 is omitted therein.

Figure 19:
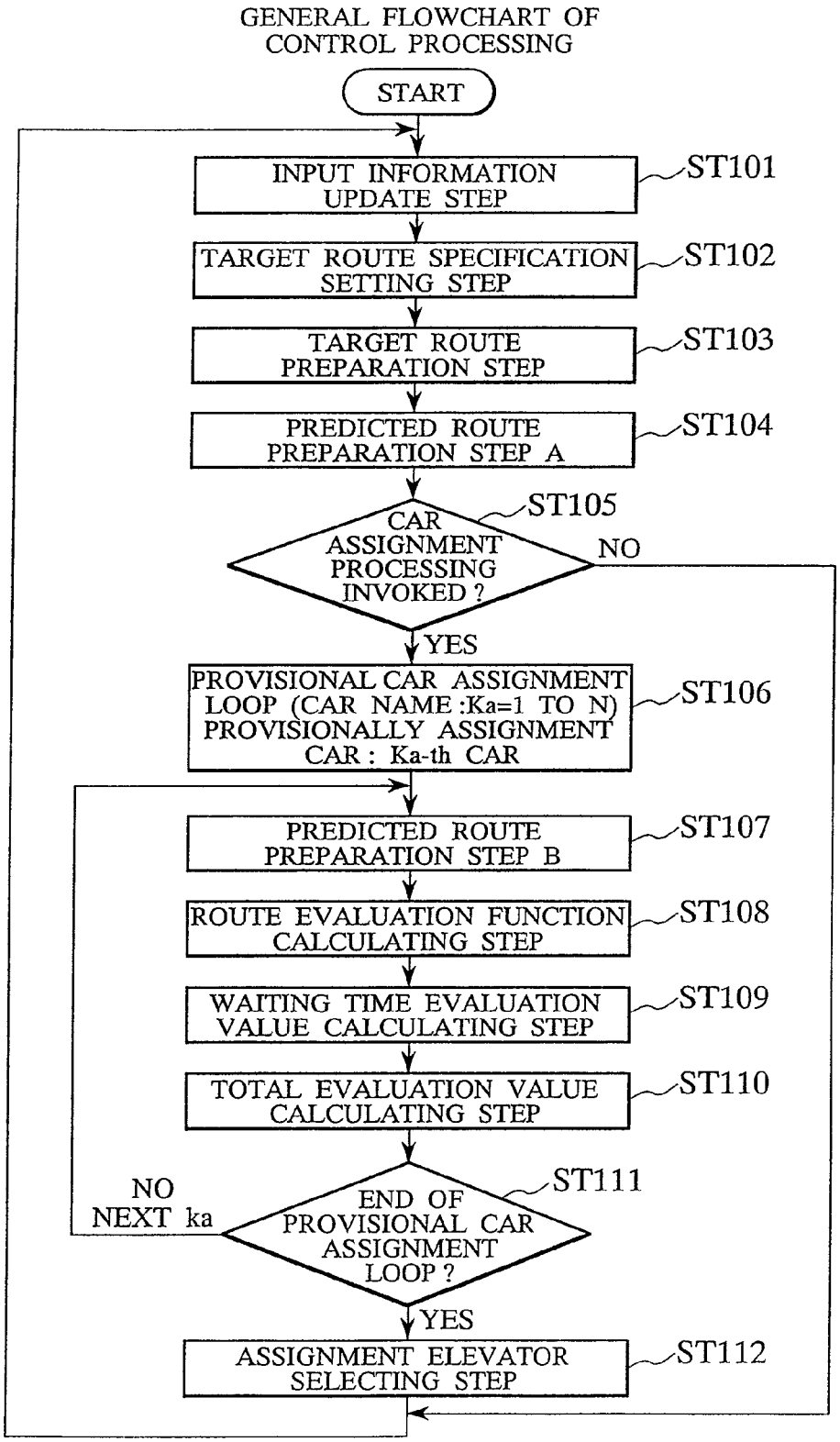
FIG. 19 is a flowchart showing the general control processing flows of an elevator group supervisory control system according to an embodiment of the present invention.

The following describes the general processing flows of the target route-based group supervisory control with reference to the flowchart of FIG. 19. Firstly, an input information update process (ST101) updates input information and data as the latest input information required for control. The input information and data include: hall call information (input from the hall call data unit 8 of FIG. 1), car call information (input from the car call data unit 9 of FIG. 1), car information (input from the car information data unit 10 of FIG. 1), traffic information (input from the individual car's specification data unit 11 of FIG. 1), traffic information-dependent average stop frequencies (input from the average stop frequency data unit 5 of FIG. 1), traffic information-dependent stoppage times (input from the stoppage time data unit 6 of FIG. 1), available car count/names (input from the available car count/name data unit 12 of FIG. 1) and serviced floors (input from the service floor data unit 13 of FIG. 1). Note that although FIG. 19 conveniently indicates that all the above information is entered at a time by the input information update process, it is also possible to enter the information in steps as necessary. For example, the information is entered in several places in the general flow of FIG. 19. It is also possible to enter some of the information at a time and another at another time. Also note that each elevator car's rated speed and other specification information (obtained from the individual car's specification data unit of FIG. 1) is set as constants which are determined depending on the building where the elevators are installed. In the subsequent target route specification setting process (ST102), a target route specification is set through the operation of the target route specification setting section 102 of FIG. 1. Basically, a temporally equal interval state is set as this specification. In a target route preparation process (ST103), target routes are prepared according to the set target route specification through the operation of the target route preparation section 103 of FIG. 1. In a predicted route preparation process A (ST104), predicted routes are prepared through operation of the predicted route preparation section 104 of FIG. 1. Then, if car assignment processing is invoked due to the detection of a newly generated hall call (ST105), a series of car assignment processes shown below the conditional branch is executed. The following describes the car assignment process flow. Here, provisional assignment of each car to the hall call is executed by loop processing. In FIG. 19, this loop is named a "provisional car assignment loop" (ST106). In the provisional car assignment loop (ST106), the variable ka which means the ka-th car is incremented one by one from 1 to N so that each elevator car is given the provisional car assignment processing in a loop form. The provisional assignment setting unit 3 of FIG. 1 executes the provisional assignment process noted above. Within the loop, a predicted route preparation process B (ST107) is executed at first. This process prepares a predicted route which the ka-th car would take if assigned to the hall call (whereas provisional assignment is not considered in the predicted route preparation process A (ST104)). This process is executed by the predicted route preparation section 104 of FIG. 1 (Information about the provisionally assigned car is obtained from the provisional assignment setting unit 3). Then, the route evaluation function is calculated for the provisionally assigned ka-th car (ka=1 to N) by using the prepared predicted route of the ka-th car (ST108). The route evaluation function is an index that basically represents the closeness between the target route and the predict route ant its calculation is executed by the route evaluation unction-used route evaluation function calculating section 105 of FIG. 1. Then, a waiting time evaluation value is calculated based on the predicted waiting time of the hall call for the provisionally assigned ka-th car (ST 109). The waiting time evaluation value for the ka-th car may directly be the time for which the hall call is predicted to wait for the ka-th car if assigned. Likewise, the largest of the times for which all hall calls already assigned to the ka-th car are respectively predicted to wait may be set as the evaluation value for the ka-th car. By weighted summation of the route evaluation function value and waiting time evaluation value calculated by the above-mentioned processes, a total evaluation value is calculated (ST110) as given by equation (A). The provisional car assignment loop processing mentioned so far is repeated until the loop is terminated (with Ka=N) (ST111). Consequently, N total evaluation values (N: the number of cars under group supervisory control) are obtained as a result of provisionally and sequentially assigning the hall call to the respective cars by incrementing ka from 1 to N. In an assignment elevator selecting process, the most appropriate car is selected for assignment based on the N total evaluation values (ST112). This process is executed by the elevator selecting unit 2 of FIG. 1. By following the flowchart of FIG. 19 described so far, it is possible to provisionally and sequentially assign the respective elevator cars to a newly generated hall call, evaluate the nearness between the predicted route and target route of each car by a route evaluation function, calculates a total evaluation value for each car by adding a waiting time-based index to the nearness evaluation value and, for actual assignment, select the most appropriate car, namely the car given the best total evaluation value (lowest evaluation value) when assigned provisionally.

The control system configuration of the elevator group supervisory control system shown in FIG. 1 includes the target route control unit 101 comprising: 1) the target route preparation section (103 of FIG. 1), 2) the predicted route preparation section (104 of FIG. 1), 3) the route evaluation function calculating section (105 of FIG. 1) and 4) the target route specification setting section (102 of FIG. 1). The following provides a detailed description of how these components operate.

Figure 2:
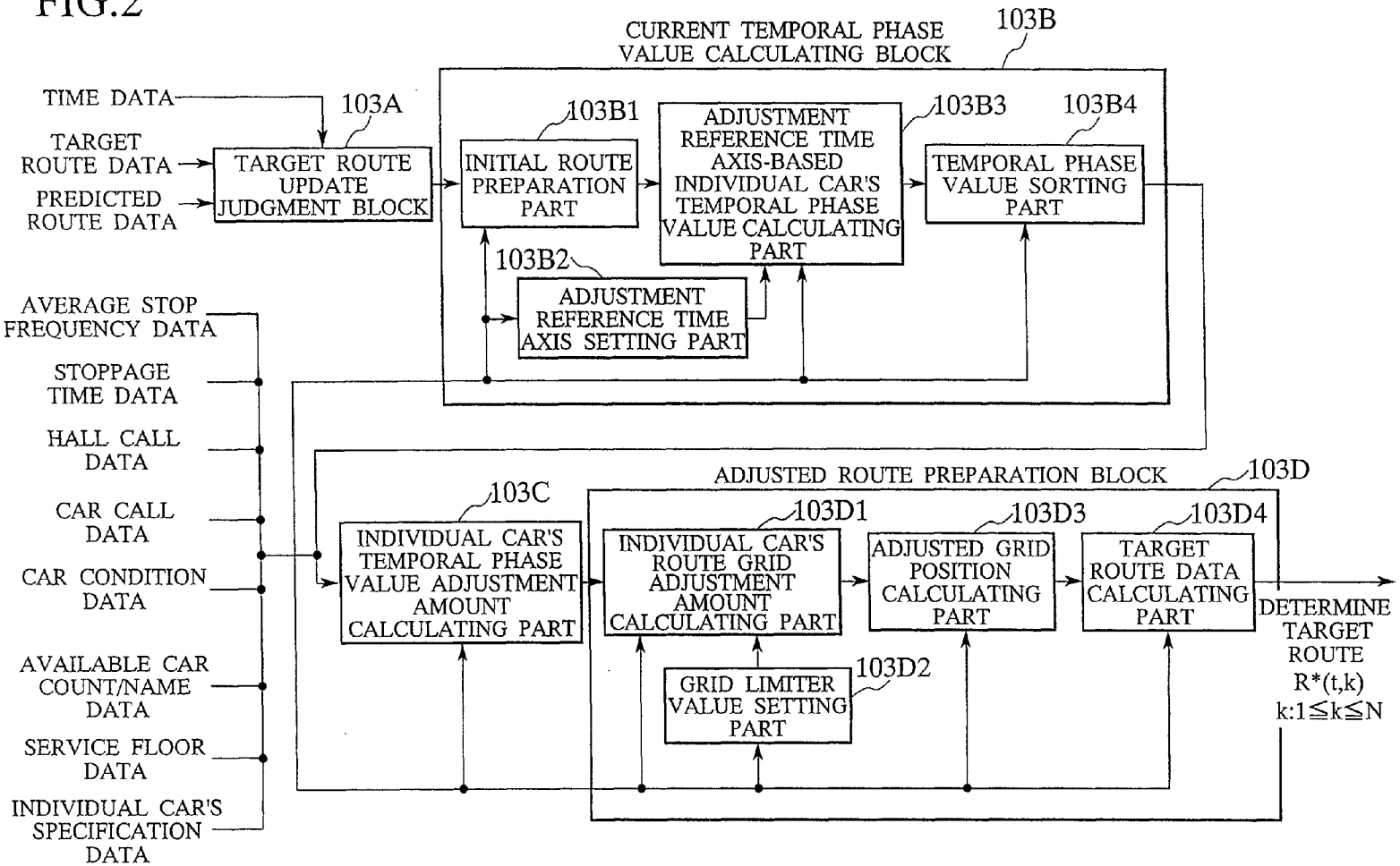
FIG. 2 shows the control configuration of the target route preparation section in the first embodiment of the present invention.

At first, with reference to FIGS. 2 and 11 through 16, a detailed description is made of what is done in the route preparation section, one of the most importance components in the present invention. FIG. 2 shows an example of the configuration of the target route preparation section. In FIG. 2, the configuration of the target route preparation section is largely composed of four components: 1) a target route update judgment block (103A of FIG. 2), 2) a current temporal phase value calculating block (103B of FIG. 2), 3) an individual car's temporal phase value adjustment amount calculating block (103C of FIG. 2) and 4) an adjusted route preparation block (103D of FIG. 2).

At first, the following describes the operations of the four components described above in order to provide a general control image. In the target route update judgment block (103A of FIG. 2), it is judged whether the current target route is to be updated. If it is judged that the target route is to be updated, the subsequent current temporal phase value calculating block (103B of FIG. 2) evaluates the temporal relation among the current predicted routes of the respective elevator cars by calculating the temporal phase value of each predicted route as an index. Using the concept of "phase" is reasonable if, for example, three-phase alternating sinusoidal waveforms are considered in electrical circuit theory. The respective waveforms are evenly separated from each other when the waveforms are separated from each other by $2\pi/3$(rad) in phase. That is, considering the route of each car as a waveform and using a "phase-like index" for it makes it easier to evaluate the route-to-route intervals of the respective cars. This "phase-like index" corresponds to what is called the temporal phase value used in the present invention as an index. The temporal phase value will be described later in detail. After the current temporal phase values are calculated in the current temporal phase value calculating block (103B in FIG. 2), the individual car's temporal phase value adjustment amount calculating block (103C in FIG. 2) calculates adjustment amounts to make the temporal phase values distributed evenly. Based on the thus calculated adjustment amounts, the adjusted route preparation block (103D in FIG. 2) adjusts the temporal phase values of the predicted routes of the respective cars. The routes obtained as a result of this adjustment become the target routes of the respective cars.

Figures 11A, 11B:
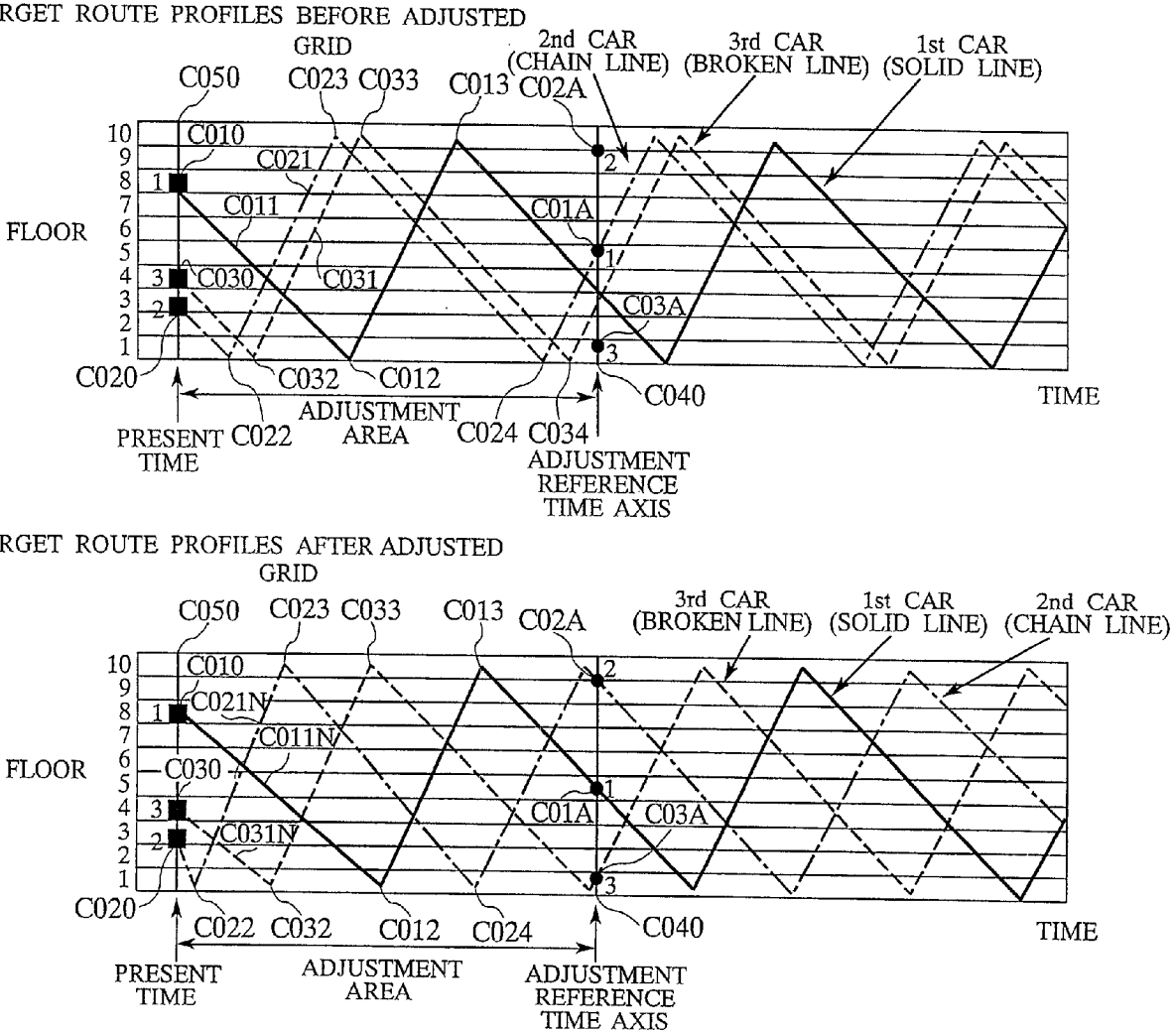
FIGS. 11A and 11B show an example of target routes prepared in the first embodiment of the present invention.

With reference to an operation image of FIGS. 11A and 11B, the following describes the general operation of the control configuration described above. FIGS. 11A and 11B illustrate an operation image of the target route preparation process executed by the target route preparation section shown in FIG. 2. At first, a description will be made of the control operation image based on the above general description of the control (FIGS. 11A and 11B will be described later in further detail.) The graph (target route profiles before adjusted) of FIG. 11A corresponds to the current predicted routes of the respective cars based on which target routes are prepared as described with FIG. 2. Here, the elevator group supervisory control system is assumed to control three cars. In FIG. 11A, the first car (C010), second car (C020) and third car (C030) are now on the present time axis (C050) and descending from the eighth floor, third floor and fourth floor, respectively. The predicted routes (predicted trajectories) of these three cars beyond the present time are respectively drawn by a solid line (C011) for the first car, a chain line (C021) for the second car and a broken line (C031) for the third car. The predicted route preparation method will be described as part of the description of the predicted route preparation section. As shown, since these trajectories are close to each other, the cars are to some extent in a string-of-cars condition. Referring back to the control configuration of the target route preparation section in FIG. 2, if it is judged by the target route update judgment block (103A in FIG. 2) to update the target routes, the current temporal phase value calculating block (103B in FIG. 2) calculates the temporal phase values of the predicted routes (C011, C021 and C031) of the respective cars by regarding these routes as waveforms of a kind. These temporal phase values are calculated at points where the predicted routes of the respective cars intersect the adjustment reference time axis (C040) in the graph of FIG. 11A. Then, based on these temporal phase values, adjustment amounts to make the respective predicted routes distributed evenly are calculated in the individual car's temporal phase value adjustment amount calculating block (103C in FIG. 2). In FIG. 11A, three black circle points on the adjustment reference time axis (C040) are for these adjustment amounts. For example, the point C01A reflects the adjustment amount for the first car. The predicted route (C011 in FIG. 11A) of the first car is adjusted by the subsequent process so as to go through this point (C01A). Likewise, the predicted route (C021 in FIG. 11A) of the second car and the predicted route (C031 in FIG. 11A) of the third car are respectively adjusted by the subsequent process so as to go through the point C02A and point C03A. This process is executed by the adjusted route preparation block 103D in FIG. 2 to prepare new target routes by adjusting the predicted routes based on the adjustment amounts. This results in trajectories shown in FIG. 11B. FIG. 11B shows the new target routes prepared based on the predicted routes shown in FIG. 11A. The target routes of the three cars (C010, C020 and C030 in FIG. 11B) are respectively drawn by a solid line (C011N) for the firs car (C010), a chain line (C021N) for the second car (C020) and a broken line (C031N) for the third car (C030). The trajectories of the target routes are characterized in that they are drawn so as to guide the cars into the temporally equal interval condition as shown in FIG. 11B. Specifically, beyond the adjustment reference axis (C040) in FIG. 11B, the target routes of the three cars are in a temporally equal interval condition. In the area (titled Adjustment Area in FIG. 11B) sandwiched between the axis (C050) representing the present time and the adjustment reference time axis (C040), the trajectories of the respective cars are drawn so as to guide the cars into the temporally equal interval condition. Based on the predicted routes shown in FIG. 11A, it is possible to prepare these routes (target routes shown in FIG. 11B) by adjusting the respective routes so as to go through the points (C01A, C02A and C03A in FIGS. 11A and 11B) obtained by the adjustment amounts. This preparation method will be described again later in detail. Before that, the following summarizes the basic concept of the target route preparation method with reference to FIGS. 12 and 13.

Figure 12:
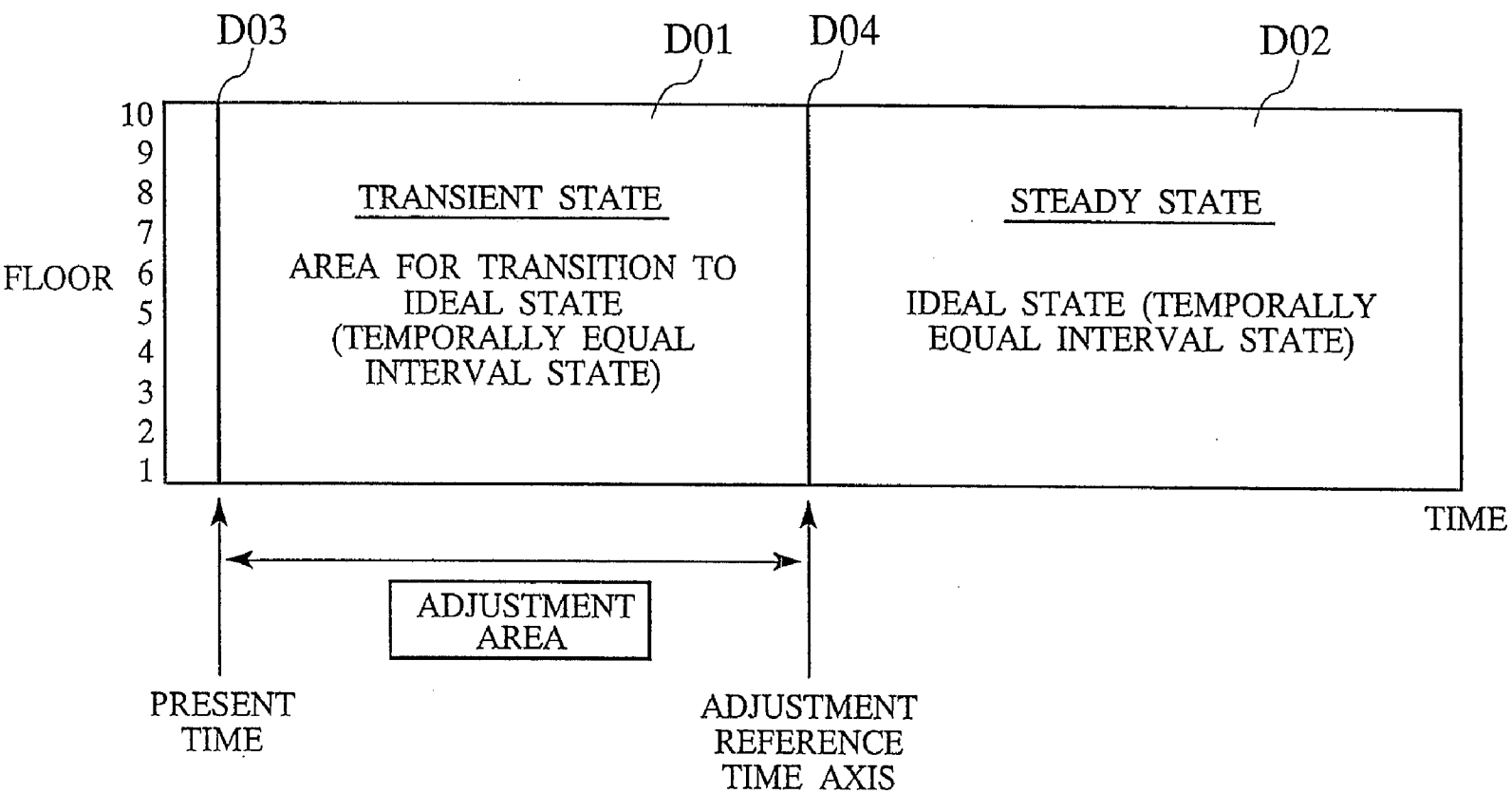
FIG. 12 is a first diagram illustrating the target route preparation concept of the first embodiment of the present invention.
Figure 13:
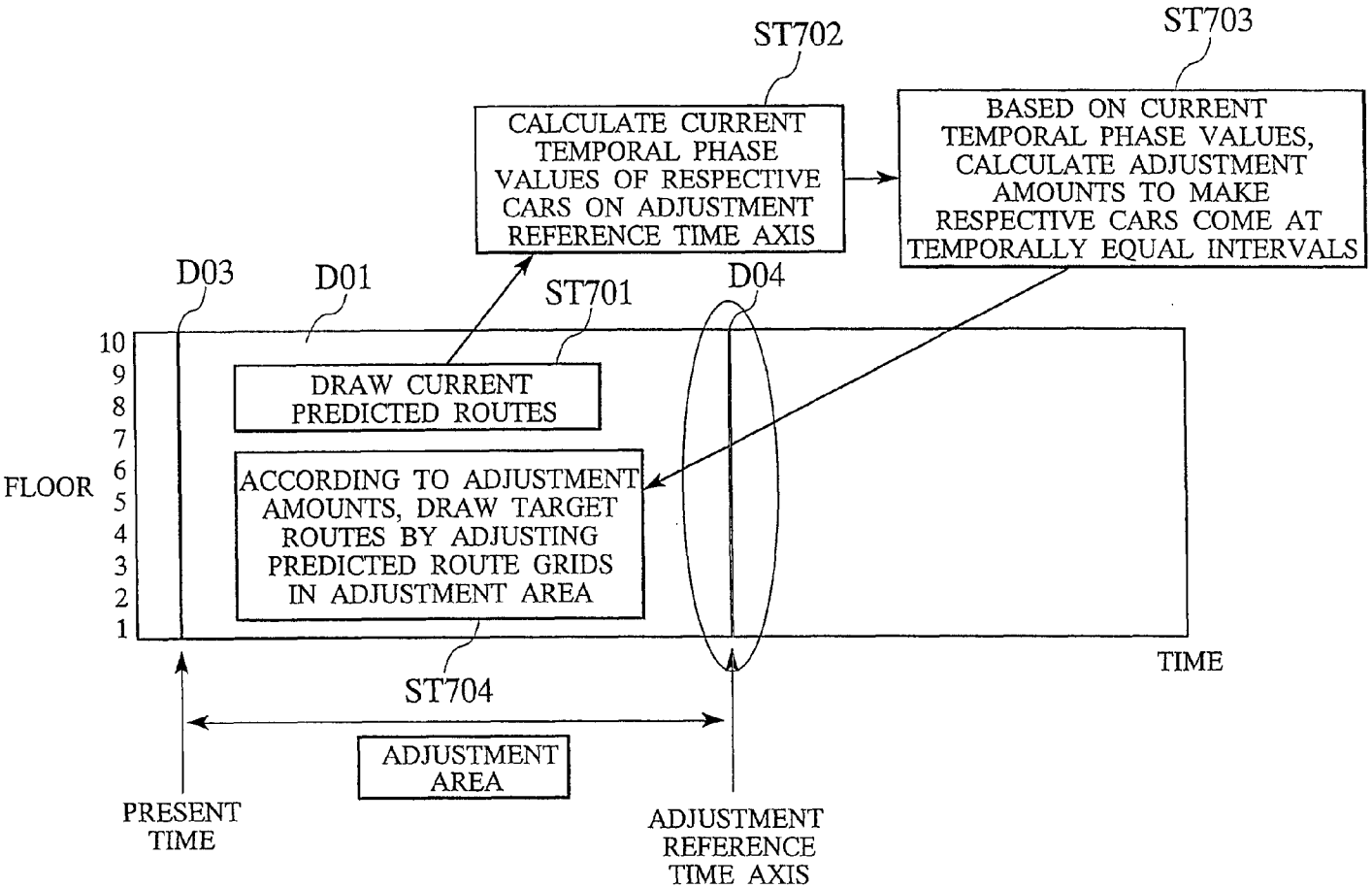
FIG. 13 is a second diagram illustrating the target route preparation concept of the first embodiment of the present invention.

FIGS. 12 and 13 represent the basic concept of how to prepare target routes unique to the present invention. Firstly, a description is made of what is shown in FIG. 12. FIG. 12 is provided to describe the concept of the adjustment area-based target route preparation method. In the graph of FIG. 12, the horizontal axis represents the time while the vertical axis represents the position of a given floor in the building. The graph is divided by the adjustment reference time axis (D04) into two areas. Of them, the left area is the adjustment area. As briefly described with FIG. 11B, the adjustment area is sandwiched between the time axis (D03) representing the present time and the adjustment reference time axis (D04). As shown in FIG. 12, this area is used as a transient state area, that is, an area for transition to an ideal temporally equal interval state. The subsequent area (D02) beyond the adjustment reference time axis is a steady state area, that is, an area where the cars are to settle in the ideal temporally equal interval state. Thus, a transient state is generated in the adjustment area so as to guide the cars into the ideal state in the steady state area (D02). FIG. 13 depicts the concept of using the adjustment area to control the target routes. This figure shows the processes that prepare target routes by using the adjustment area. As already described briefly with FIG. 2, target routes are prepared by four processes: 1) drawing the current predicted routes (ST701 in FIG. 13), 2) calculating the current temporal phase values of the respective cars on the adjustment reference time axis (ST702), 3) based on the current temporal phase values, calculating adjustment amounts to make the respective cars come at temporally equal intervals (ST703) and 4) obtaining target routes by adjusting the predicted route grids in the adjustment area according to the adjustment amounts (ST704). Thus, target routes, key to the present invention, are prepared by the four basic processes shown in FIG. 13 according to the basic concept described with FIG. 12.

The description has been made of the basic components concerning the preparation of target routes, their general operations and the basic preparation concept and processes.

Figure 15:
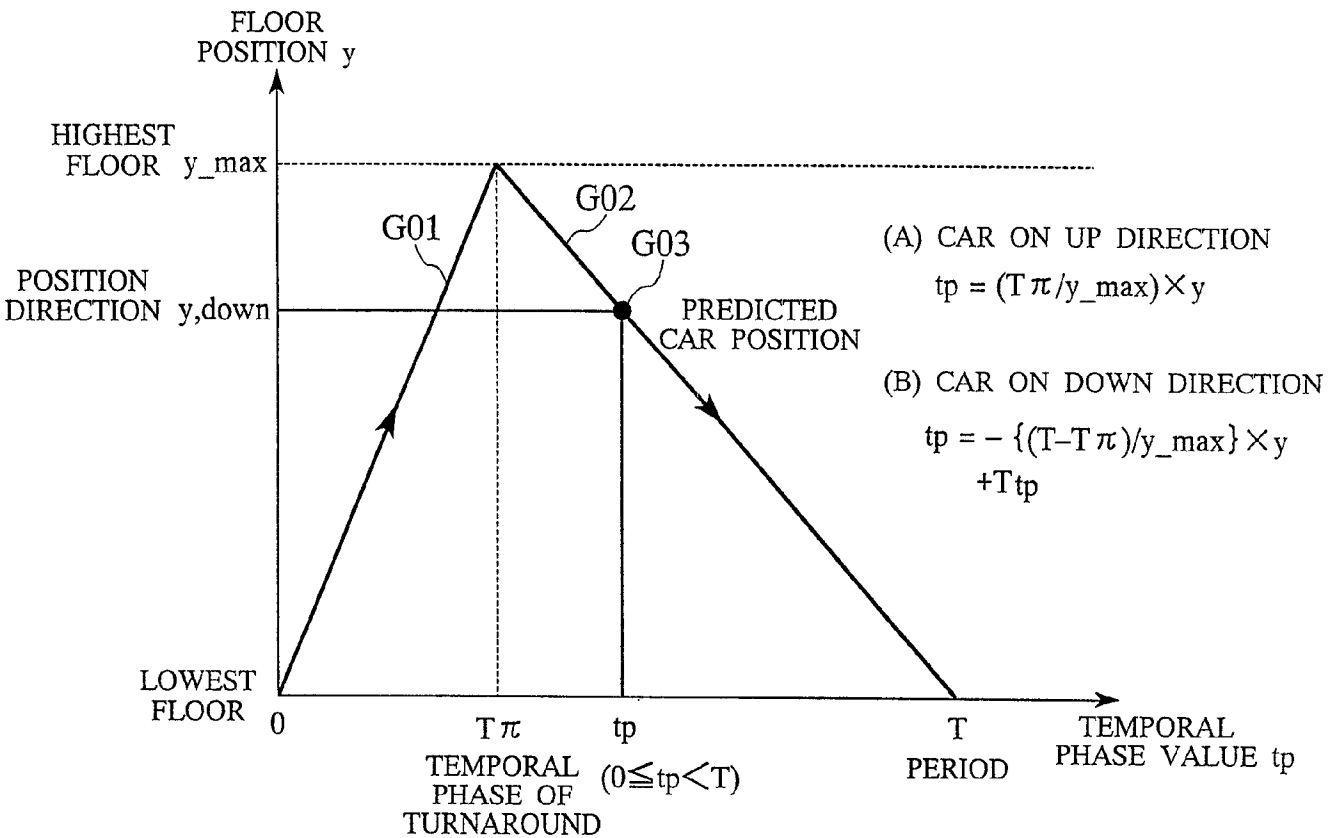
FIG. 15 illustrates the concept of the temporal phase value.

A detailed description is made of how target routes are prepared with reference to FIGS. 2, 11, 14 and 15. At first, a description will be made of the internal components of the target route preparation section shown in FIG. 2. The current temporal phase value calculating block (103B in FIG. 2) comprises an initial route preparation part (103B1), an adjustment reference time axis setting part (103B2), an adjustment reference time axis-based individual car's temporal phase value calculating part (103B3) and a temporal phase value sorting part (103B4). In the initial route preparation part (103B1), the current predicted routes of the respective cars are prepared as the initial routes. These initial routes correspond to the pre-adjustment target route profiles shown in FIG. 11A. In the adjustment reference time axis setting part (103B2), an adjustment reference time axis is set. In the adjustment reference time axis-based individual car's temporal phase value calculating part (103B3), the temporal phase values of the respective cars are calculated on the adjustment reference time axis. With reference to FIG. 15, the following describes the temporal phase value in detail. In FIG. 15, the horizontal axis of the graph represents the temporal phase value while the vertical axis represents the position of a given floor in the building. The graph shown in FIG. 15 indicates a predicted route of an elevator car on the assumption that this predicted route is given by a periodic function with a period of T. For example, the predicted route (C011 in FIG. 11A) of the first car in FIG. 11A corresponds to this route. As shown, the predicted route (C011 in FIG. 11A) of the first car in FIG. 11A is given by a periodic function. The graph of FIG. 15 shows one period of this predicted route given by a periodic function. Starting at the lowest floor, this one-period has a car-ascending segment (G01 in FIG. 15) and a car-descending segment (G02 in FIG. 15), making one round in the building. Here, the phase is considered as the floor position. Accordingly, when the car is at the lowest floor, the phase is considered 0 or $2\pi$ (rad). Likewise, when the car is at the highest floor, the phase is $\pi$ (rad). In addition, similar to a sinusoidal wave, the phase is considered positive in polarity when the phase is between 0 and $\pi$ (the car is ascending) whereas negative when the phase is between $\pi$ and $2\pi$ (the car is descending). When the phase is $\pi$ (at time $T\pi$ in FIG. 15), since the polarity of the phase changes from positive to negative, this point of time is named the turnaround temporal phase $T\pi$. In addition, y_max is used to mean the position of the highest floor. Under these assumed conditions, the temporal phase value tp ($0 \leqq tp < T$) of a given point of a predicted route is defined by the following equation.

$$tp=(T\pi/y_\max)\times y(\text{car ascending: } 0\leqq tp<T) \quad (1)$$

$$tp=-\{(T-T\pi)/y_\max\}\times y+T(\text{car descending: } T\pi\leqq tp<T) \quad (2)$$

Where, the amount y is represented by the floor axis and means the car's predicted floor position. For example, the temporal phase value tp of a predicted route point (G03 in FIG. 15) whose position is y can be calculated according to equation (1) $(T\pi/y_\max)\times y$. Temporal phase value tp is characterized in that the amount of phase of any route point can be evaluated uniquely since dimensional conversion is made from phase to time. Thus, by using temporal phase values, it is possible to easily evaluate the degree of temporal equality of intervals among the predicted routes of the respective cars.

Returning to FIG. 2, in the adjustment reference time axis-based individual car's temporal phase value calculating part (103B3) of the current temporal phase value calculating block (103B in FIG. 2), the temporal phase values of points at which the predicted routes of the respective cars intersect the adjustment reference time axis are calculated by using equation (1) or (2). FIGS. 14A and 14B show how a target route is prepared. To facilitate understanding, only one car (2nd car) is picked up in this figure. In FIG. 14A, the predicted route (C021 in FIG. 14A) is shown as a pre-adjustment target route profile. This predicted route is prepared in the initial route preparation part (103B1 in FIG. 2). The adjustment reference time axis (C040) in FIG. 14A is set in the adjustment reference time axis setting part (103B2 in FIG. 2). The temporal phase value tp of the predicted route of the second car on this adjustment reference time axis (C040 in FIG. 14A), or the temporal phase value tp of a point (C060 in FIG. 14A) where the predicted route of the second car intersects the adjustment reference time axis is calculated by the adjustment reference time axis-based individual car's temporal phase value calculating part (103B3 in FIG. 2). In the case of the intersecting point C060 in FIG. 14A, since the car is ascending (between 0 (rad) and π (rad) in phase), the temporal phase value tp can be calculated from the car's predicted position y according to equation (1). Here, the period T can be obtained from the following data: the number of stories of the building, width per story, car's rated speed and current traffic-dependent average stop frequency and stoppage time. Likewise, the turn-around temporal phase Tπ can also be obtained from the above-mentioned data. The highest floor's position y_max is a fixed value dependent on the building. Referring back to FIG. 2, after the temporal phase values of the respective cars are calculated by the adjustment reference time axis-based individual car's temporal phase value calculating part (103B3 in FIG. 2), these temporal phase values of the respective cars are sorted into the increasing order of phase by the temporal phase value sorting part (103B4 in FIG. 2). Hereinafter, this order is denoted as increasing phase order. As described with FIG. 15, the temporal phase value tp of each car is defined during one period of the waveform. In FIG. 15, the more the waveform is advanced, the larger its temporal phase value becomes. On the other hand, adjustment is made so that 0≦tp(k)<T is met by tp. For example, consider the pre-adjustment target route profiles (or predicted routes) of three cars in FIG. 11A. According to the points at which the predicted routes (C011, C021 and C031 in FIG. 11A of the respective cars intersect the adjustment reference axis (C040 in FIG. 11A), the third car has the smallest temporal phase value, followed by the second car and then the first car in increasing phase order. This order is determined in the temporal phase value sorting part (103B4 in FIG. 2) by using a sorting algorithm (for example, selection sort, bubble sort or the like). Based on the calculated temporal phase values of the respective cars and their increasing phase order, the adjustment amount calculating block (103C of FIG. 2) calculates the car-to-car interval of each car in terms of temporal phase, compares this temporal phase value with a reference value for equal intervals and calculates their difference as the adjustment amount for the temporal phase value of the car. The basic concept is to calculate the car-to-car interval (in terms of temporal phase) of each car from the predicted routes, compare it with a reference value for equal intervals and calculate their difference as the amount for adjustment. Taking the case of FIG. 11A, the following describes how the individual car's temporal phase value adjustment amount calculating block (103C in FIG. 2) operates. In FIG. 11A, as described earlier, the third car comes first, followed by the second car and the first car in increasing phase order according to the temporal phase values of the predicted routes (C011, C021 and C031 in FIG. 11A) of the respective cars on the adjustment reference time axis (C040 in FIG. 11A). If one period of each predicted route is given by T (common to the three cars), the temporal phase value tp(k) of the k-th car is: tp(3)=0.09T for the third car, tp(2)=0.17T for the second car and tp(1)=0.77T for the first car. The respective car-to-car intervals are calculated in increasing phase order. The result is tp(2)−tp(3)=0.08T for the second-to-third car interval, tp(1)−tp(2)=0.6T for the first-to-third car interval and tp(3)−tp(1)+T=0.32T for the third-to-first car interval. Thus, the respective car-to-car intervals can be evaluated quantitatively using the temporal phase values. That is, it is found from the result that the second and third cars are very close to each other. Since one period is T, the target car-to-car interval to run the cars in a temporally equal interval condition is given by T/N if N cars are collectively controlled. In the case of FIG. 11A, the target interval is T/3=0.33T since three cars are collectively controlled. The difference between this target interval and the current car-to-car interval should be eliminated by adjustment. For instance, the second-to-third car interval should be corrected by +0.25T (=0.33T−0.08T), the first-to-second car interval should be corrected by −0.27T (=0.33T−0.6T) and the third-to-first car interval should be corrected by +0.01T (=0.33T−0.32T). In this context, the positive sign means to increase the interval (widen the current interval toward the target) whereas the negative sign means to decrease the interval (narrow the current interval toward the target). Based on these correction values for adjusting the intervals, correction values for the temporal phase values of the respective cars are calculated. This is possible by using the following algorithm. For example, assume that three cars, car A, car B and car C in increasing phase order, are collectively controlled (for generalization, here, each car is given an alphabetic name). Therefore, 0≦tp(A)≦tp(B)≦tp(C)≦T is met. Here, let us denote the temporal phase time of a given car by Δtp(k) (k means car k). For each car-to-car interval to become equal to the target interval T/3 after adjustment, the following equations must be met.

$$(tp(B)+\Delta tp(B))-(tp(A)+\Delta tp(A))=T/3 \tag{3}$$

$$(tp(C)+\Delta tp(C))-(tp(B)+\Delta tp(B))=T/3 \tag{4}$$

$$(tp(A)+\Delta tp(A))-(tp(C)+\Delta tp(C))+T=T/3 \tag{5}$$

In equation (3), the adjusted temporal phase value is given by tp(B)+Δtp(B) where the current temporal phase value is given by tp(B). Accordingly, equation (3) indicates that the difference between the adjusted temporal phase value of car B and the adjusted temporal phase value of car A, or the interval between them, must be T/3. Since the above three equations are not independent of each other, only these three equations can not be solved for Δtp(A), Δtp(B) and Δtp(C). Therefore, another condition is added. This condition is that the center of gravity of the distributed cars must not change after they are adjusted. This condition is expressed in terms of the temporal phase value of each car by the following equation.

$$(tp(A)+tp(B)+tp(C))/3=\{(tp(A)+\Delta tp(A))+(tp(B)+\Delta tp(B))+(tp(C)+\Delta tp(C))\}/3 \tag{6}$$

Equation (6) can be simplified to equation (7) below.

$$\Delta tp(A))+\Delta tp(B)+\Delta tp(C)=0 \tag{7}$$

Solving equations (3), (4), (5) and (7) for Δtp(A), Δtp(B) and Δtp(C) results in the following equations.

$$\Delta tp(A)=(-2/3)tp(A)+(1/3)tp(B)+(1/3)tp(C)+(-1/3)T \tag{8}$$

$$\Delta tp(B)=(1/3)tp(A)+(-2/3)tp(B)+(1/3)tp(C) \tag{9}$$

$$\Delta tp(C)=(1/3)tp(A)+(1/3)tp(B)+(-2/3)tp(C)+(1/3)T \tag{10}$$

In summary, when the temporal phase values tp(A), tp(B) and tp(C) of three cars A, B and C meet the relation 0≦tp(A)≦tp(B)≦tp(C)<T, correction values Δtp(A), Δtp(B) and Δtp(C) to adjust the temporal phase values of the respective cars so as to put the respective cars in a temporally equal interval state without changing the center of gravity of the distributed respective cars can be obtained respectively according to equations (8), (9) and (10). In the case of FIG. 11A where the third, second and first cars correspond respectively to cars A, B and C, tp(A)=tp(3)=0.09T, tp(B)=tp(2)=0.17T and tp(C)=tp(1)=0.77T. Accordingly, as the correction values for the respective cars, Δtp(A)=Δtp(3)=−0.081T, Δtp(B)=Δtp(2)=0.177T and Δtp(C)=−0.096T are obtained according to equations (8), (9) and (10). For verification, the adjusted temporal phase values of the respective cars are calculated. The result is tp(A)+Δtp(A)=tp(3)+Δtp(3)=0.010T, tp(B)+Δtp(B)=tp(2)+Δtp(2)=0.343T and tp(C)+Δtp(C)=tp(1)+Δtp(1)=0.677T. All car-to-car intervals are therefore 0.33T, meeting the interval-equalizing requirement. Referring back to FIG. 2, the following provides a detailed description of how the adjusted route preparation block (103D of FIG. 2) operates to prepare adjusted routes by using the correction values obtained in the individual car's temporal phase value adjustment amount calculating block (103C in FIG. 2). At first in the adjusted route preparation block, correction values to adjust the grids of the pre-adjustment target routes (corresponding to the predicted routes) of the respective cars are calculated by the individual car's route grid adjustment amount calculating part (103D1 in FIG. 2). Grids are shown in FIG. 14A. To facilitate understanding, FIG. 14A shows the pre-adjustment target route (corresponding to the predicted route) of the second car alone. A grid is defined as a turnaround point of a route of concern within the adjustment area. In FIG. 14A, three turnaround points C022, C023 and C024 of the pre-adjustment target route (C021) are grids (restricted to these three turnaround points within the adjustment area). The temporal phase of the route of concern can be adjusted by changing the horizontal positions of these grids. The grid adjustment values are determined one by one for the grids in temporal order starting from the grid nearest to the present time. The grid adjustment values must amount in total to the adjustment value determined for the car. Each grid is given the largest adjustment value which does not exceed a limiter value set to the grid by the grid limiter value setting part (103D2 in FIG. 2). Taking the case of FIG. 14A, the following describes this method. Δgtp (k=2, i=1, 2, 3) is used to denote a adjustment value to be given to a grid. Here, k means the number of the car (k=2 for the second car) whereas 1 means the number of the grid. The grids, in temporal order from the present time forward, are given increasing numbers. In addition, LΔgtp (k=2, i=1, 2, 3) is used to denote the limiter value set as the maximum adjustment value allowed for the grid. The temporal phase adjustment value for the second car, tp(2)+Δtp(2)=0.343T as calculated above, is distributed as Δgtp(k=2, i=1), Δgtp (k=2, i=2) and Δgtp (k=2, i=3) which do not exceed the respective limiter values. For example, if the limiter values of the respective grids are LΔgtp(k=2, i=1)=0.2T, LΔgtp(k=2, i=2)=0.2T and LΔgtp(k=2, i=3)=0.1T, the adjustment value for the first grid, Δgtp(k=2, i=1), is set to 0.2T(=LΔgtp(k=2, i=1); limiter value) at first. The remaining required temporal phase adjustment is 0.343T−0.2T=0.143T. Then, the adjustment value for the second grid, Δgtp(k=2, i=2), is set to 0.143T. Since the remaining required temporal phase adjustment is zero, the adjustment value for the third grid, Δgtp(k=2, i=3), is set to 0. Referring back to FIG. 2, the adjusted grid position calculating part (103D3 in FIG. 2) calculates the adjusted positions (gp_N(k, i) of the respective grids from the adjustment values (Δgtp(k, i)) for the respective grids and the pre-adjustment positions (gp(k, i)) of the respective grids. For example, if the car is the second car (k=2) and there are three grids (i=, 2, 3), the respective grids are located as given by the following equations.

$$gp_N(k=2, i=1)=gp(k=2, i=1)+\Delta gtp(k=2, i=1) \quad (11)$$

$$gp_N(k=2, i=2)=gp(k=2, i=2)+\Delta gtp(k=2, i=1)+\Delta gtp(k=2, i=2) \quad (12)$$

$$gp_N(k=2, i=3)=gp(k=2, i=3)+\Delta gtp(k=2, i=1)+\Delta gtp(k=2, i=2)+\Delta gtp(k=2, i=3) \quad (13)$$

Since an adjustment value for a grid is effective to the subsequent grids, the position of the last grid is adjusted by the total temporal phase adjustment value required for the car. By connecting the thus adjusted grid positions, it is possible to prepare a new target route. The target route data calculating part (103D4 in FIG. 2) updates the target route data by calculating new target data. In FIG. 14B, a route drawn by a thick line is the adjusted target route prepared based on the pre-adjustment target route (corresponding to a predicted route) shown in FIG. 14A. In FIG. 14A, the pre-adjustment target route is drawn by a thin chain line (C021) whereas the adjusted target route is drawn by a thick chain line (C021N). An adjusted grid position is calculated in the adjusted grid position calculating part (103D3 in FIG. 2). As a result of adjustment, the grid C022 is shifted to C022N. Likewise, the grids C023 and C024 are shifted respectively to C023N and C024N. By connecting these three grids, it is possible to draw the thick chain line route (C021N) as a newly updated target route. As apparent from FIG. 14B, the newly updated target route (adjusted target route) goes through the post-adjustment target point set according to the temporal phase adjustment value. As shown in FIG. 11B, since the routes of the respective cars are adjusted so as to go through their post-adjustment target points as described above, the resultant target routes (C011N, C021N and C031N) are in temporally equal interval state after the adjustment reference time axis (C040 in FIG. 11B). As a matter of course, the respective routes (C011N, C021N, C031N) go through their post-adjustment target points (C01A, C02A and C03A in FIG. 11B). It is also apparent that the target routes adjusted by the grids in the adjustment area play a transient role to guide the cars into a temporally equal interval condition beyond the adjustment reference time axis. The foregoing has provided a detailed description of the target route preparation process based on FIG. 2.

Figure 20:
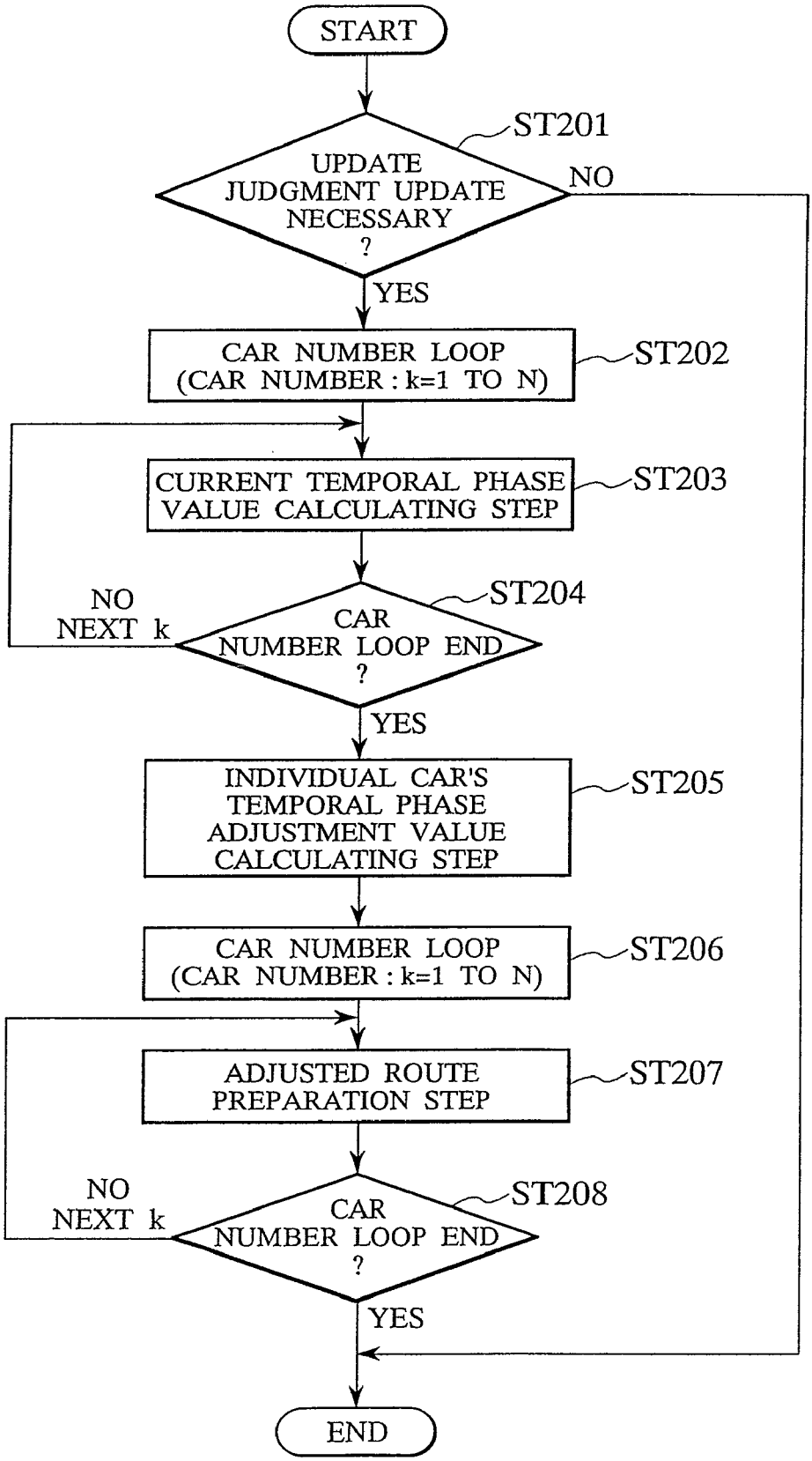
FIG. 20 shows the flows of processing to prepare target routes.

With reference to the flowchart of the target route preparation process in FIG. 20, the following describes the flows of the target route preparation process. At first, it is judged whether the target routes are to be updated (ST201). This step is executed by the target route update judgment block (103A) in FIG. 2. If it is decided to perform no update as the result of the update judgment, control exits the process. If it is decided to perform update, control goes to the subsequent step. The update judgment method will be described later in detail with reference to FIG. 24. If it is decided to update the target routes, a car number loop (ST202) is executed to apply loop processing to each car. In the loop processing, a current temporal phase value calculating step is executed (ST203). This step is executed by the current temporal phase value calculating block (103B) described earlier with FIG. 2. When a current temporal phase value of the last car is calculated, control exits the car number loop (ST204). Then, a temporal phase adjustment value is calculated for each car (ST205). This is executed by the individual car's temporal phase value adjustment amount calculating block (103C) in FIG. 2. This processing is already described in detail. Based on the temporal phase adjustment values calculated for the respective cars, an adjusted route preparation step is performed for each car (ST207) by executing the car loop again (ST206). This adjusted route preparation step is executed by the adjusted route preparation block (103D) in FIG. 2. This processing is already described in detail as well. When the above-mentioned processing is performed for all cars, control exits the car number loop (ST208) to terminate the target route preparation process.

Figure 24:
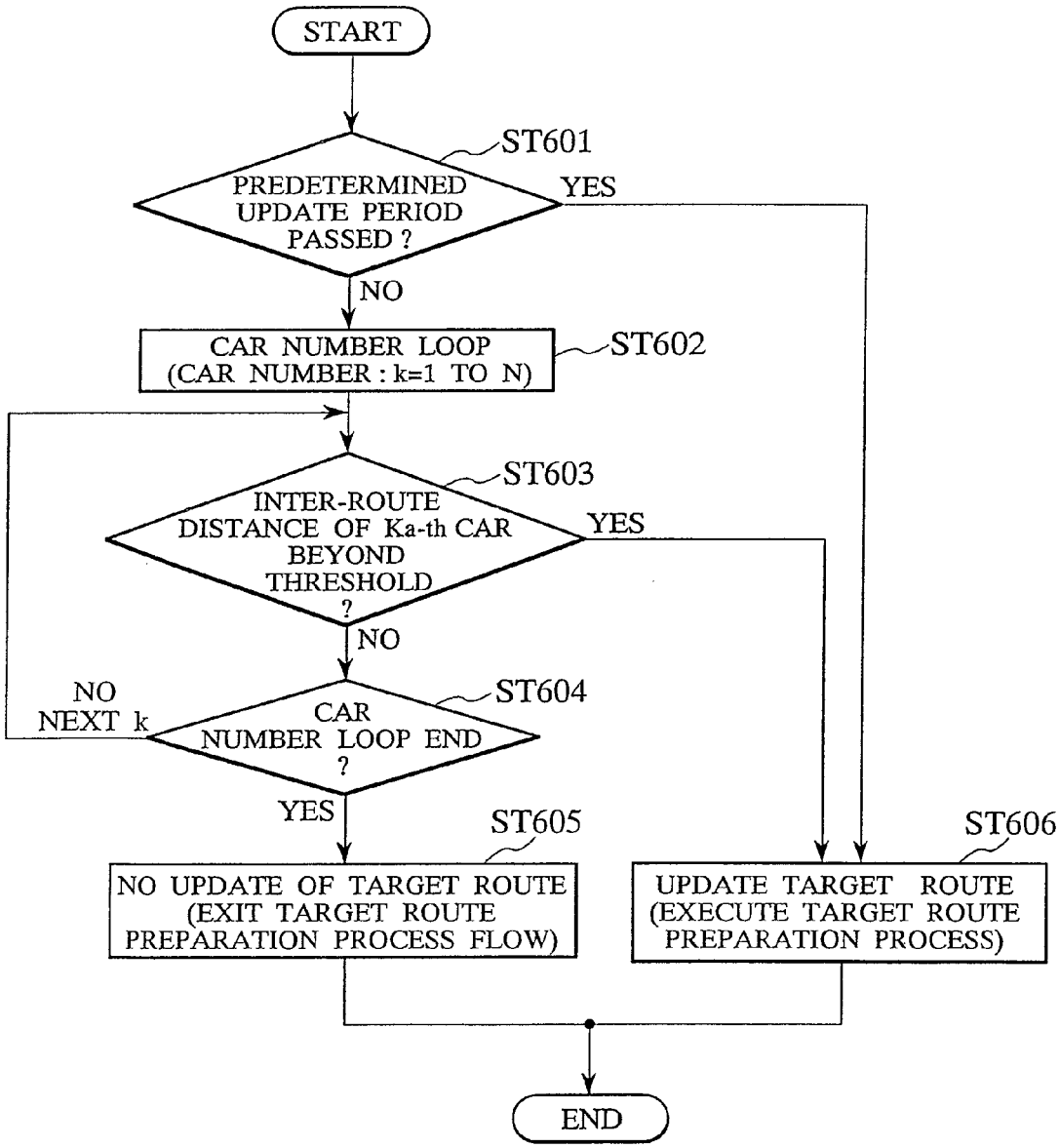
FIG. 24 is a flowchart of the target route update judgment process.

With reference to the flowchart of FIG. 24, the following provides a detailed description of the target route update judgment process. Largely, target routes may be updated by three methods: 1) periodically updating the target routes at certain intervals; 2) detecting the distance between the target route and predicted route of each car (hereinafter, called the inter-route distance) and, if the inter-route distance exceeds a certain value, updating the target routes; and 3) a combination of methods 1) and 2). Of them, FIG. 24 corresponds to method 3). Either method 1) or method 2) may be executed by partly using method 3). At first, a watch or timer is examined to check if the predetermined update period has passed (ST601 in FIG. 20). If the update period has passed, the target route update processing is performed (ST606). This processing corresponds to the processing done by the components downstream of the target route update judgment block (103A in FIG. 2), or the processing which is done (by the ST202 and subsequent steps in FIG. 20) if the result of the update judgment (ST201) is YES. If the update period has not passed, loop processing is done through a car number loop (ST602 in FIG. 24) to calculate the distance (inter-route distance) between the target route and predicted route of each car and judges whether this distance is not smaller than a predefined threshold (ST603). The distance (inter-route distance) between the target route and the predicted route is an index to indicate how the target route is distant from the predicted route. This will be described later in detail with reference to FIGS. 18A and 18B. In short, a predetermined threshold is used to judge whether the target route is so deviated from the predicted route as to require correction. If the inter-route distance of any one car is beyond the threshold (ST603), the target route update processing is performed (ST606). The inter-route distance of each car is checked (ST606). If the inter-route distance of any car is smaller than the threshold, the current target routes are used without updating them (ST605). Two different policies may be adopted in updating the target routes. One is to keep the target routes always appropriate by correcting them as necessary ('flexible target routes'). The other is not to change the target routes as long as possible once determined ('rigid target routes'). Since either has both merits and demerits, it is reasonable to appropriately set the two control parameters, namely, the update period and inter-route distance threshold described with FIGS. 18A and 18B.

The foregoing has provided a description of the target route preparation method, the core of the target route-based elevator group supervisory control of the present invention. The following provides a description of how to prepare predicted routes which are consulted in guiding the actual trajectories of the cars to the target routes.

How to prepare predicted routes is described below with reference to FIGS. 5, 6, 19, 21 and 22. Referring to FIG. 19, firstly note that predicted routes are prepared in two different cases. As already described, FIG. 19 is a flowchart showing the general control processing flows of an elevator group supervisory control system in accordance with the present invention. In FIG. 19, there are two predicted route preparation processes: Predicted Route Preparation Step A (ST104 in FIG. 19) and Predicted Route Preparation Step B (ST107 in FIG. 19). The predicted route preparation step A prepares predicted routes without assuming assignment to any hall call. In other words, only the current condition is reflected in the preparation of predicted routes. Such a predicted route is used to judge its distance from the target route and as a pre-adjustment target route or the prototype (initial profile before adjustment) of a target route to be prepared. The other predicted route preparation step B prepares a predicted route of each car on the provisional assumption that the car is assigned. Such predicted routes are used to evaluate provisional assignments, for example, when a new hall call occurs.

Figure 6:
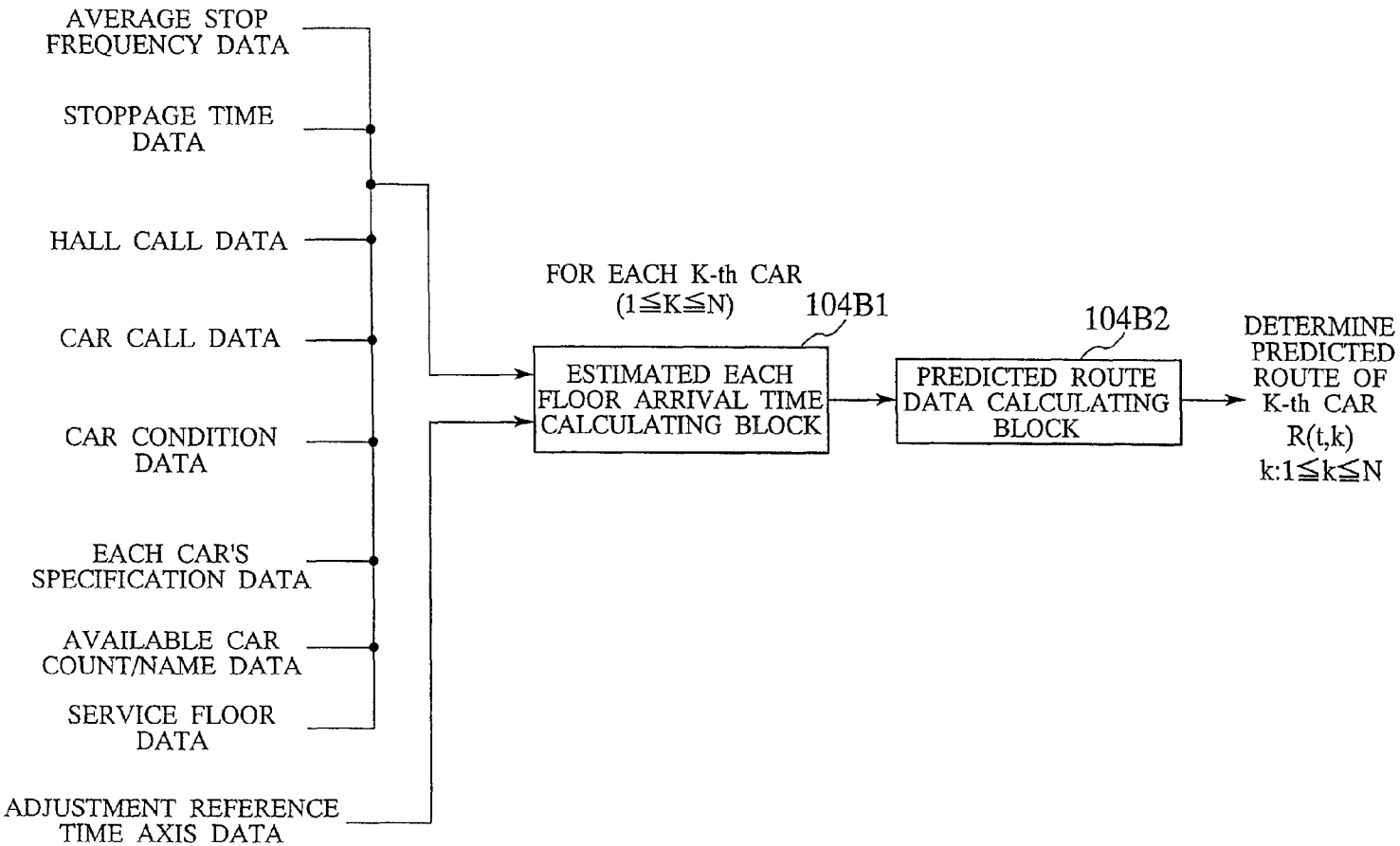
FIG. 6 shows the control configuration of the predicted route preparation section in an embodiment of the present invention.

Referring to FIG. 6, the following firstly provides a description of how predicted routes are prepared by the predicted route preparation step A described above. In FIG. 6, an estimated each floor arrival time calculating block 104B1 calculates the estimated times of arrival at the respective floors by using: average stop frequency data and stoppage time data dependent on the current traffic condition; data on the hall calls assigned to the respective cars (hall call-generated floors, etc.); data on the car calls occurring in the respective cars (car call-generated floors, etc.); car condition data (current position, direction, speed, etc.); each car's specification data (rated speed, etc.); available car count/name data; and service floor data (data on the floors to be served by the respective cars). As a simple example, assume that a car of concern in a four-floor building is stopped at the first floor and is going to ascend. For simplification, it is assumed here that it takes 2 seconds per story for the car to move and the car waits 10 seconds per stop. In addition, it is assumed that the car is assigned to a hall call generated at the second floor and a car call demanding transport to the fourth floor is generated (by a passenger who has entered the car at the first floor). The current traffic condition is normal with relatively heavy inter-floor traffic. Accordingly, the average stop frequencies at the respective floors are assumed to be—first floor (up): 0.25, second floor (up): 0.25, third floor (up): 0.25, fourth floor (up): 0.25, fifth floor (down): 0.25, fourth floor (down): 0.25, third floor (down): 0.25, second floor (down): 0.25. Here, an average stop frequency means the number of times the car stops at a given floor on the average during one round trip in the building. Under these conditions, the estimated times of arrival at the respective floors are calculated—first floor (up): 0 sec, second floor (up): 2 sec, third floor (up): 14 sec, fourth floor (up): 18.5 sec, fifth floor (turnaround): 30.5 sec, fourth floor (down): 35 sec, third floor (down): 39.5 sec, second floor (down): 44 see and 0.25, first floor (turnaround): 48.5 sec. Reversely, these estimated times of arrival at the respective floors indicate the predicted positions of the car at given future times. Accordingly, in a coordinate system where the horizontal axis represents the time while the vertical axis represents the floor position, a predicted route can be prepared by connecting the points each of which is plotted according to the estimated time of arrival at the floor position. Taking the above case, (t(sec), y(floor)) points (0, 1), (2, 2), (14.3, 3), (18.5, 4), (30.5, 5), (35, 4), (39.5, 3), (44.2, 2) and (48.5, 1) can be plotted in a coordinate system with a horizontal time axis (t axis) and a vertical floor position axis (y axis). A predicted route can be prepared by connecting these points. Although stoppage times are omitted in this example, it is also possible to include stoppage times in drawing the predicted route. If stoppage times are included by adding stop end points, the predicted route is prepared more accurately. Referring back to FIG. 6, a predicted route data calculating block (104B2) prepares predicted route data through the above-described procedure based on the estimated times of arrival at the respective floors calculated by the estimated each floor arrival time calculating block (104B1). To summarize the procedure, the estimated times of arrival at the respective floors, considered as the predicted positions of the car at future times, are plotted in a coordinate system where the horizontal axis represents the time while the vertical axis represents the floor position. A predicted route is prepared by connecting the plotted points. This predicted route can be regarded as a function plotted in a coordinate system where the horizontal axis represents the time while the vertical axis represents the floor position. This function can be expressed by $y=R(t, k)$ wherein t, y and k ($1 \leqq k \leqq N$: N is the total number of cars) respectively denote the time, the floor position and the number of the car.

Figure 21:
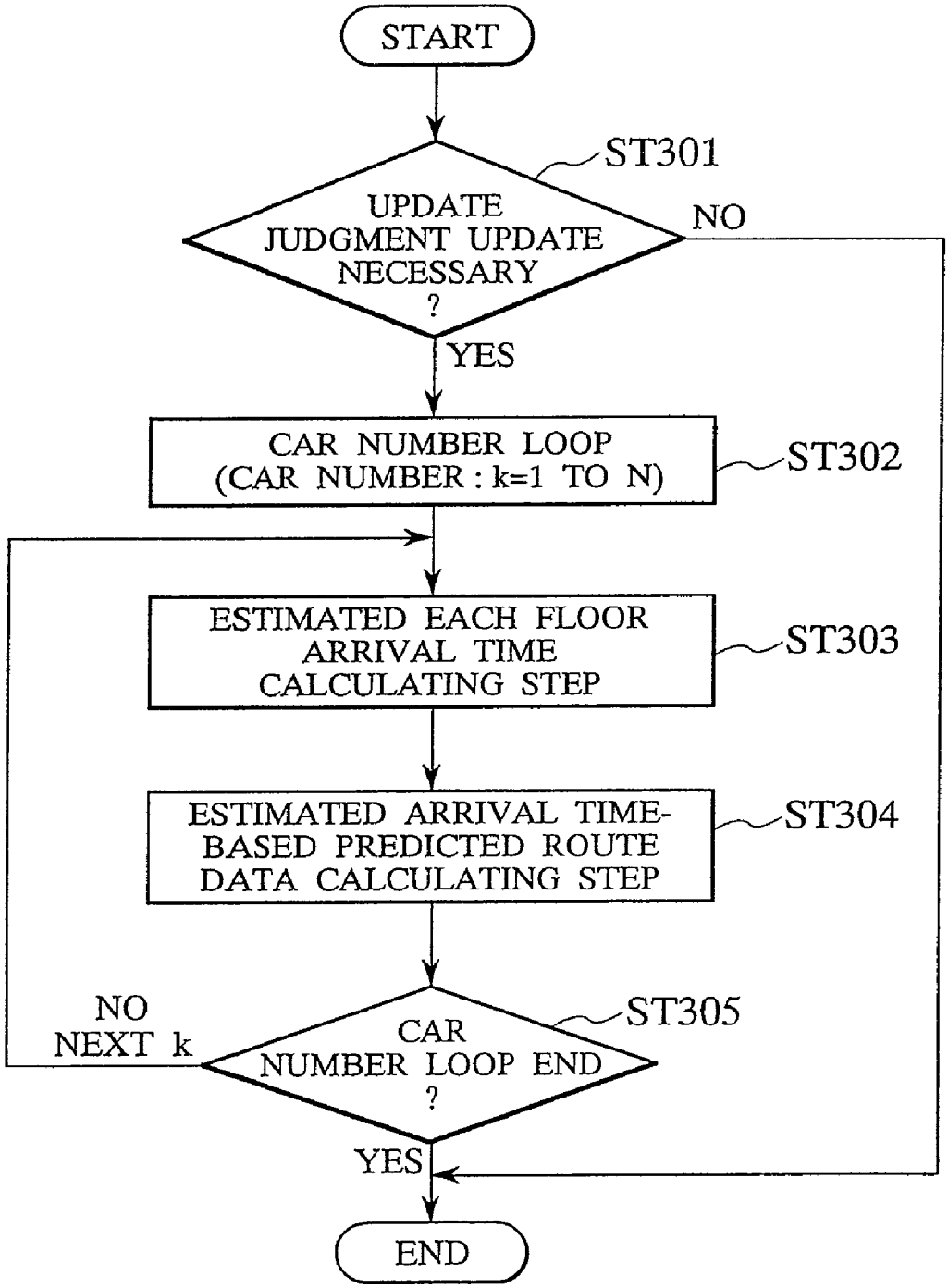
FIG. 21 shows the flows of the predicted route preparation process A.

Then, the following describes the flows of processing done by the predicted route preparation step A to prepare predicted routes with reference to FIG. 21. Firstly, it is judged whether predicted routes are to be updated (ST301). Since updating the predicted routs every time imposes a great load on the processor consisting of a microcomputer or the like, this step intends to update the predicted routes at such long intervals (for example, 0.5 sec) as not to cause a substantial load. If it is decided to perform no update as the result of the update judgment, control exits the process. If it is decided to perform update, control goes to the subsequent step. In this case, through a car number loop (ST302), an estimated each floor arrival time calculating step (ST303) and an estimated arrival time-based predicted route data calculating step (S304) are executed for each car. These steps are executed respectively by the estimated each floor arrival time calculating block (104B1) and predicted route data calculating block (104B2) in FIG. 6. These steps were already described in detail. When the above-mentioned processing is performed for all cars, control exits the process (ST305). In this manner, the predicted routes of all cars are appropriately updated at certain intervals. Although new hall calls and car calls occur irregularly, it is possible to apply proper predicted routes depending on the situation by following the flowchart of FIG. 21.

Figure 5:
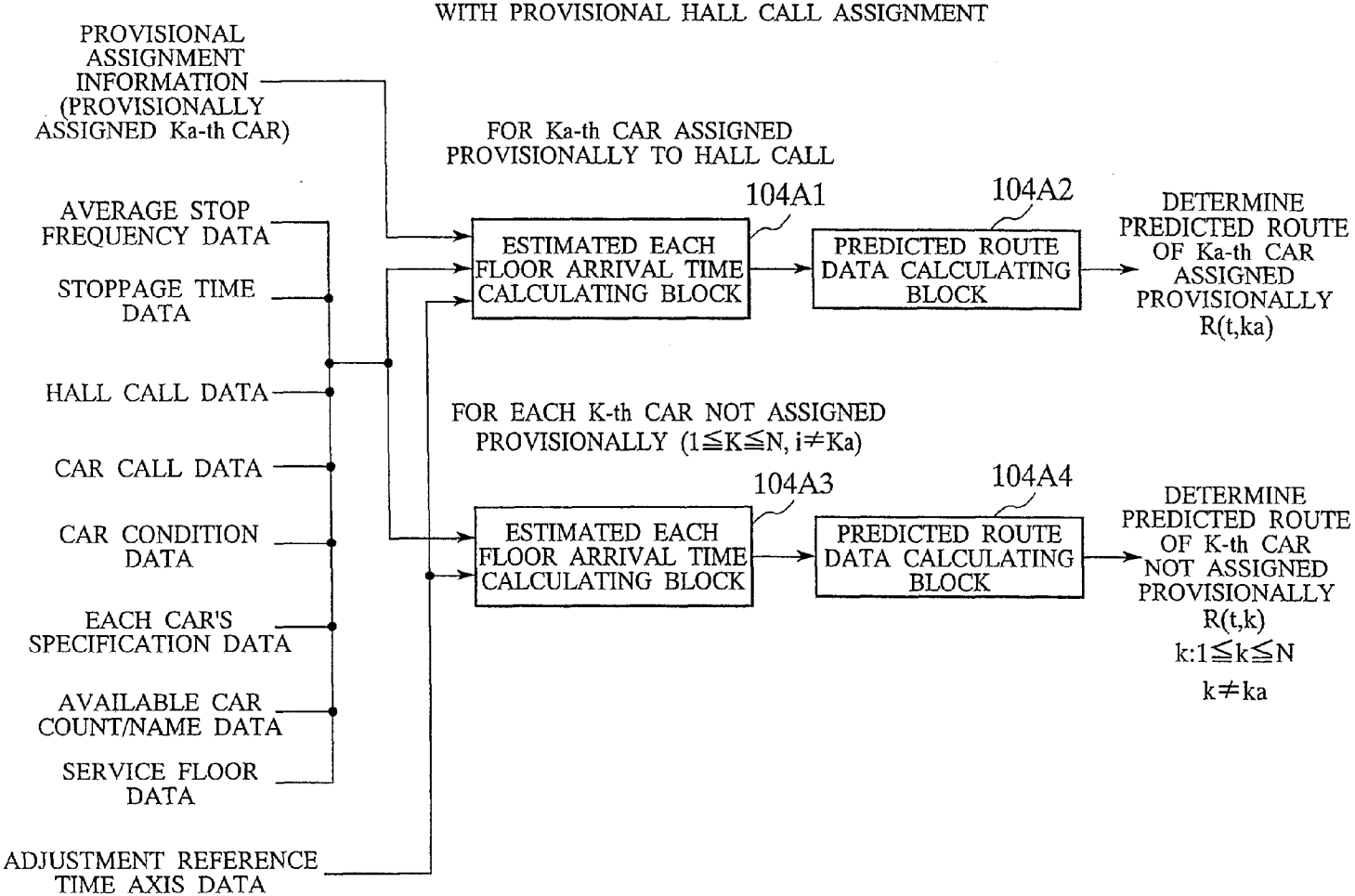
FIG. 5 shows the control configuration of the predicted route preparation section in an embodiment of the present invention.

FIG. 5 shows the components of the predicted route preparation section which implement the predicted route preparation step B (ST107 in FIG. 19 to prepare assignment-considered predicted routes). Conceptually, the predicted route preparation step B is identical to the predicted route preparation step A of FIG. 6 except that each car is provisionally assigned and this provisional assignment is reflected in the preparation of its predicted route. Specifically, if the ka-th car is provisionally assigned to a new hall call, estimated times of arrival at the respective floors are calculated (by an estimated each floor arrival time calculating block 104A1) from the provisional assignment information (provisionally assigned car (ka-th car) and hall call-generated floor and direction) in addition to the input information required for the preparation of an ordinary predicted route (information described with FIG. 6). Further, based on the result, predicted route data is calculated (by a predicted route data calculating block). Each predicted route obtained in this manner by reflecting a provisional assignment can be expressed as a function R (t, ka) in a time-floor position coordinate system. For each car (other than ka-th car) which is not provisionally assigned, the same process as the process described with FIG. 6 is done. Estimated times of arrival at the respective floors are firstly calculated by the estimated each floor arrival time calculating block (104A3) and, based on the result, predicted route data is prepared by the predicted route data calculating block (104A4). Each predicted route obtained can be expressed as a function R(t, k)($1 \leqq k \leqq N$, $k \neq ka$).

Figure 22:
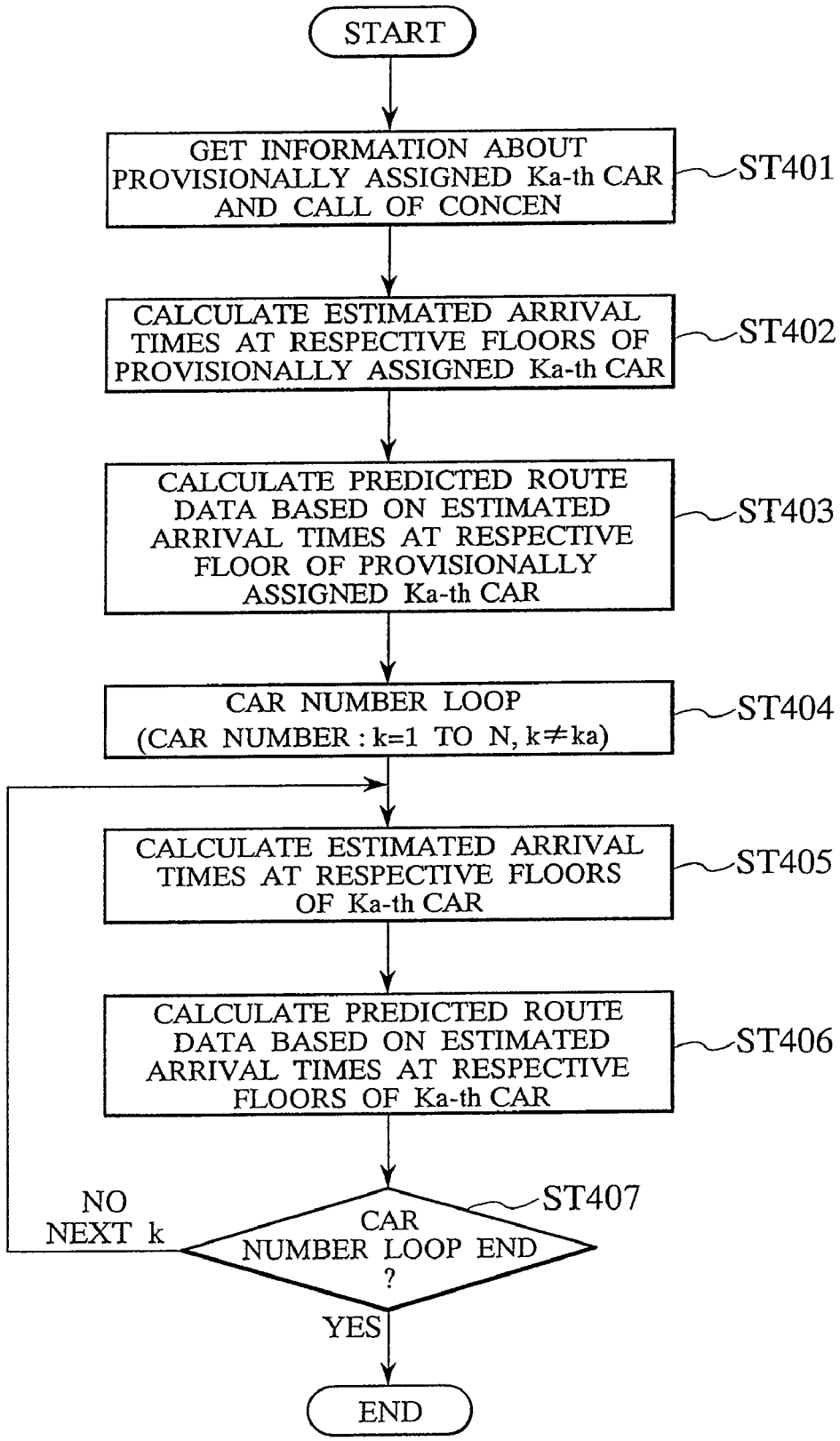
FIG. 22 shows the flows of the predicted route preparation process B.

FIG. 22 shows a flowchart of the predicted route preparation processing which corresponds to the above-described predicted route preparation step B. Firstly, provisional assignment (hall call-generated floor, direction, etc.) information concerning a provisionally assigned ka-th car is obtained (ST401). Estimated times of arrival at the respective floors are calculated based on the information (ST402) and predicted route data is calculated based on the estimated times of arrival at the respective floors (ST403). Then, a car number loop is executed (ST404) to calculate the estimated times of arrival at the respective floors for each car excluding the provisionally assigned ka-th car (ST405). Further, based on the result, predicted route data is calculated (ST406). This process is terminated after executed for all cars excluding the ka-th car (ST406). Thus, it is possible to prepare the predicted route of the provisionally assigned ka-th car and the predicted route of each k-th car not assigned provisionally ($1 \leqq k \leqq N$, $i \neq ka$).

The foregoing has provided a description of how predicted routes are prepared. The following describes the inter-route distance, an index of nearness between a target route and a predicted route, and the route evaluation function which is used as an index in determining which car to assign. In the conventional method, "assignment evaluation function" to quantitatively evaluate each assignment to a call is defined as a function of the predicted waiting time. The control method of the present invention is greatly characterized in that "assignment evaluation function" is defined as a function of the quantity (inter-route distance) representing the target route-to-predicted route nearness instead of the predicted waiting time.

Figure 18A:
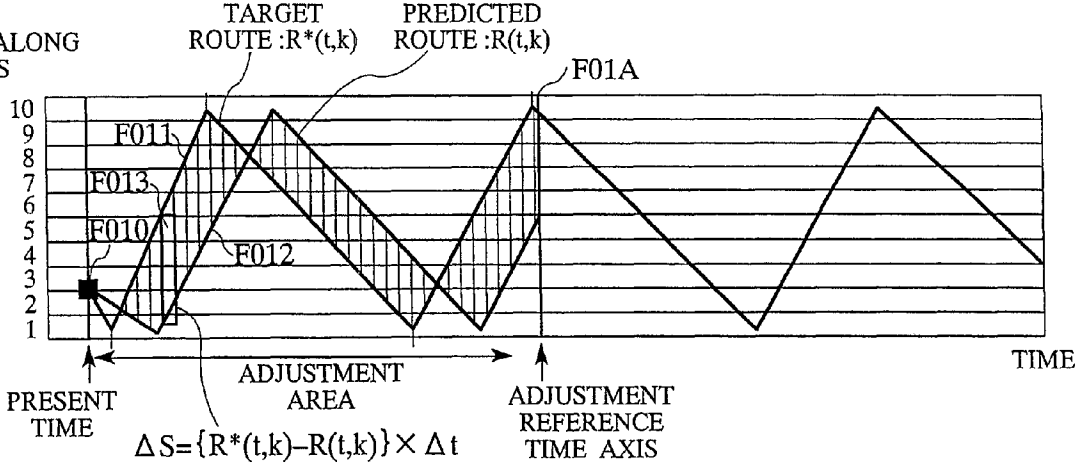
FIGS. 18A and 18B illustrate how the inter-route distance between a target route and predicted route is calculated.
Figure 18B:
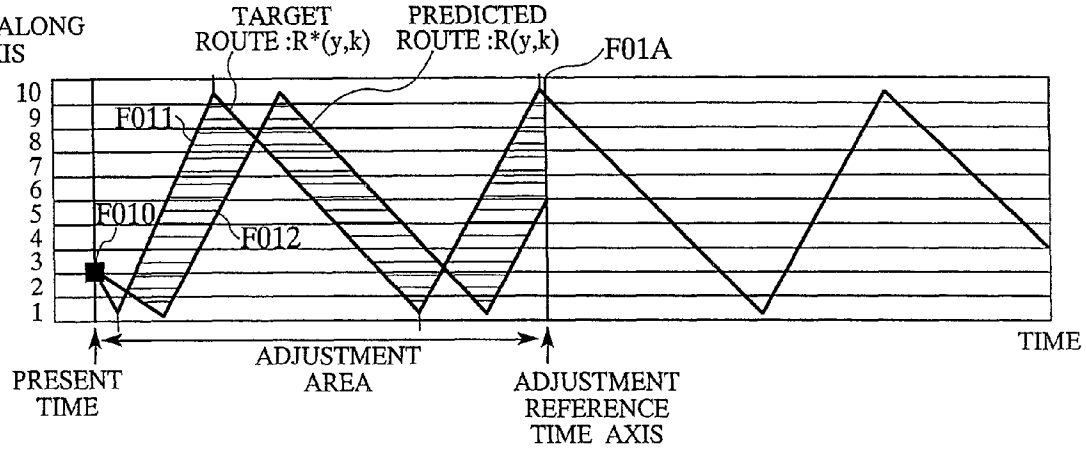

With reference to FIGS. 18A and 18B, the following firstly describes the inter-route distance, an index to represent the nearness between a target route and a predicted route. Route distance calculation methods are shown in FIGS. 18A and 18B. A description is made of FIG. 18A at first. In the graph of FIG. 18A where the horizontal axis represents the time while the vertical axis represents the floor position, a target route R*(t, k) (where, t: time and k: car number of the car) is drawn as a trajectory F011 and a predicted route R(t, k) is as a trajectory F012. From FIG. 18A, the area sandwiched by the target route and predicted route is considered the most appropriate index to indicate their nearness. Apparently, the area decreases as the two routes come closer to each other. When the two routes agree with each other, the area is zero. Accordingly, the area sandwiched between the function R*(t, k) representing the target route and the function R(t, k) representing the predicted route is defined as the inter-route distance. The area can be obtained by integration. The integration may be done along either the time axis or the floor height axis. In FIG. 18A, the integration is done along the time axis. This integration is given by $$\int\{R^*(t, k)-R(t, k)\}dt \tag{14}$$

The area in the time range from the present time to the adjustment reference time axis, that is, the area in the adjustment area is obtained. Accordingly, the area to be calculated is shown in FIG. 18A as vertical line-filled regions sandwiched between the target route R*(t, k) (F011) and the predicted route R(t, k) (F012). L[R*(t, k), R(t, k)] is here used to denote the inter-route distance between the target route and the predicted route. L[R*(t, k), R(t, k)] is given by the following equation.

$$L[R^*(t, k), R(t, k)]=J\{R^*(t, k)-R(t, k)\}dt \tag{15}$$

(integration interval=adjustment area)

In actual calculation by a microcomputer or the like, the above-described integration is realized approximately by adding up the areas of rectangles. For example, assume a rectangle (F013) of length Δt in the direction of the time axis, sandwiched between the target route and the predicted route. ΔS is used to denote the area of this rectangle. ΔS is given by the following equation.

$$\Delta S=\{R^*(t, k)-R(t, k)\}\times\Delta t$$

Such a rectangle is cut out for every Δt over the adjustment area. The value of equation (15) can be calculated approximately by adding up the areas of such rectangles. This method can be expressed by the following equation.

$$L[R^*(t, k), R(t, k)]=\Sigma\Delta S=\Sigma\{R^*(t, k)-R(t, k)\}\times\Delta t$$
(Rectangles are cut out over the adjustment area.) (16)

In the case of FIG. 18B, integration is done along the floor position axis. Symbol y is used as a variable representing the floor position and R*(y, k) and R(y, k) to denote the target route and the predicted route, respectively. Accordingly, the inter-route distance is given by the following equation.

$$L[R^*(y, k), R(y, k)]=\int\{R^*(y, k)-R(y, k)\}dy$$ (integration interval=all floors) (17)

As apparent from FIG. 18B, when integration is done along the floor position axis, R*(y, k) (and R(y, k) as well) can take two or more values for the same y value. This must be considered in actual calculation. Therefore since this integration along the floor position axis involves complex processing, integration along the time axis (equation (15) or (16)) should be used in actual cases.

Figure 7:
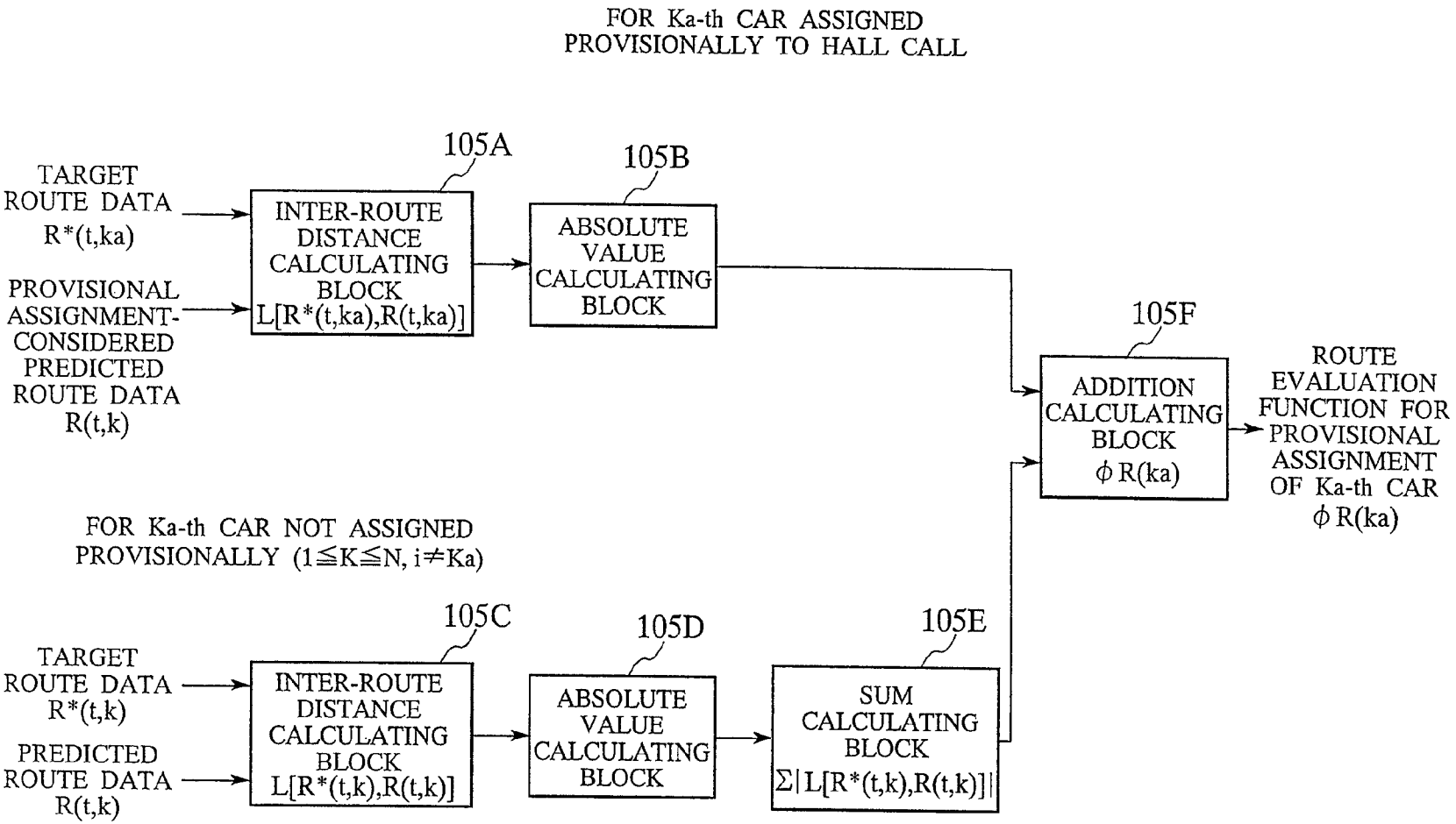
FIG. 7 shows the control configuration of the route evaluation function calculating section in an embodiment of the present invention.
Figure 23:
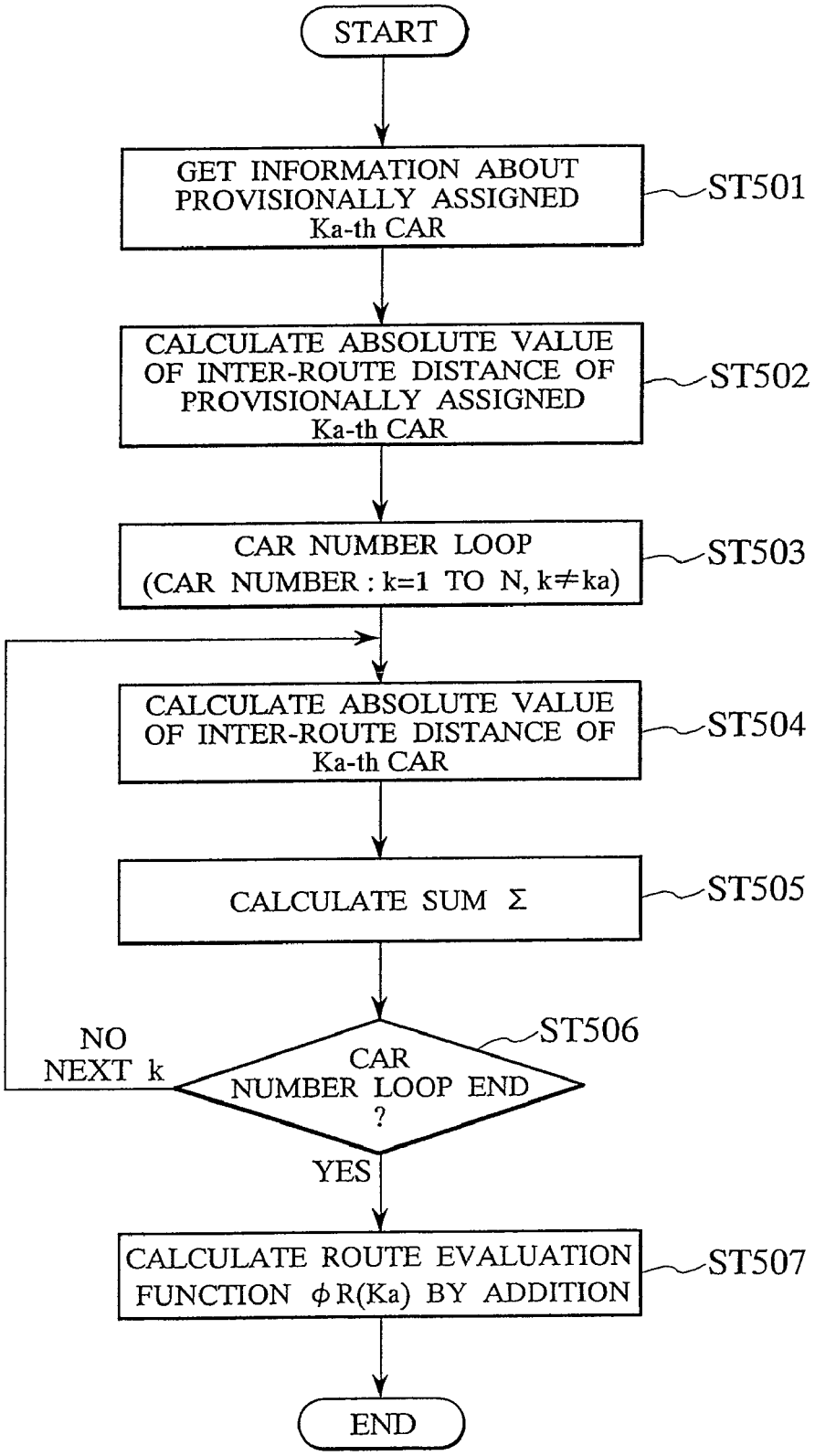
FIG. 23 shows the flows of processing to calculate the route evaluation function.

With reference to FIGS. 7 and 23, the following provides a detailed description of the route distance index-based route evaluation function calculating section (105 in FIG. 1) which calculates the value of the assignment evaluation function to evaluate each provisional assignment by using inter-route distances. This processing corresponds to the route evaluation function calculating step (ST108 in FIG. 19) where for each provisionally assigned car, the inter-route distances between the target route and predicted route of the provisionally assigned car and between those of each non-assigned car are calculated and, based on the result, the route evaluation function is calculated. Referring to FIGS. 7 and 23, this route evaluation function calculating process is described below in detail. In FIG. 7, it is assumed that the ka-th car is provisionally assigned. From the ka-th car's target route data R*(t, ka) and predicted route data R(t, ka), the inter-route distance L[R*(t, ka), R(t, ka)] is firstly calculated by an inter-route distance calculating block 105A. Stopping of the car due to the provisional assignment is reflected in the predicted route data R(t, ka). The calculated inter-route distance L[R*(t, ka), R(t, ka)] is converted to an absolute value |L[R*(t, ka), R(t, ka)]| by an absolute value calculating block 105B. In addition, for the non-assigned k-th car ($1\leqq k\leqq N$, $k\neq ka$, N=total number of elevator cars), an inter-route distance calculating block 105C calculates the inter-route distance L[R*(t, k), R(t, k)] from the k-th car's target route data R*(t, k) and predicted route data R(t, k). The inter-route distance L[R*(t, k), R(t, k)] is converted to an absolute value |L[R*(t, k), R(t, k)]| by an absolute value calculating block 105D. The absolute inter-route distance of each car excluding the ka-th car is calculated in this manner and added up by a sum calculating block 105E. This sum is expressed as below.

$$\Sigma|L[R^*(t, k), R(t, k)]|(1\leqq k\leqq N, k\neq ka, N=\text{total number of elevator cars})$$ (18)

The result obtained by the absolute value calculating block 105F and the result obtained by the sum calculating block 105E are added by an addition calculating 105B to calculate the route evaluation function ΦR(ka) to evaluate the provisional assignment of the ka-th car. The route evaluation function ΦR(ka) is expressed as below.

$$\Phi R(ka)=|L[R^*(t, ka), R(t, ka)]|+\Sigma|L[R^*(t, k), R(t, k)]|(1\leqq k\leqq N, k\neq ka, N=\text{total number of elevator cars})$$ (19)

In the case of a predicted waiting time-used conventional assignment evaluating function, it is typical to evaluate only the provisionally assigned car (only the first term in the case of equation (19)). In the case of the inter-route distance-used assignment evaluating function according to the present invention, it is characterized in that an evaluation term for non-assigned cars (corresponding to the second term in equation (19)) is added to the evaluation term for provisionally assigned car.

FIG. 23 shows a flowchart of the route evaluating function calculating process described with FIG. 7. Its flows are briefly described below. Firstly, information about the provisionally assigned ka-th car (provisionally assigned hall call-generated floor, direction, etc.) is obtained (ST501). The inter-route distance L[R*(t, ka), R(t, ka)] of the provisionally assigned ka-th car is calculated based on the information and converted to an absolute value (ST502). Then, a car number loop is executed for each car excluding the provisionally assigned ka-th car (ST503). Within the car number loop, the inter-route distance L[R*(t, k), R(t, k)] of the k-th car is calculated and converted to an absolute value (ST504). Further, this value of each car is added up (ST505) by repeating the car number loop until the processing is done for all cars (ST506). When the processing is complete for all cars, the route evaluation function ΦR(ka) given by equation (19) is calculated by adding the absolute value |L[R*(t, ka), R(t, ka)]| of the inter-route distance of the provisionally assigned ka-th car to the sum Σ|L[R*(t, k), R(t, k)]| of the absolute value of the inter-route distance of each car excluding the provisionally assigned ka-th car (ST507).

Based on the route evaluation function ΦR(ka) ($1\leqq k\leqq N$) described above, it is decided which car is to be assigned to the hall call. N ΦR(ka) values are calculated. The smallest ΦR(ka) value indicates that the assignment would make the target routes of the respective cars closer to their predicted routes than the other assignments. Accordingly, a car which minimizes ΦR(ka) is selected as the car to be assigned to the hall call of concern. This process is executed by the assignment elevator selecting unit 2 in FIG. 1.

Figure 4:
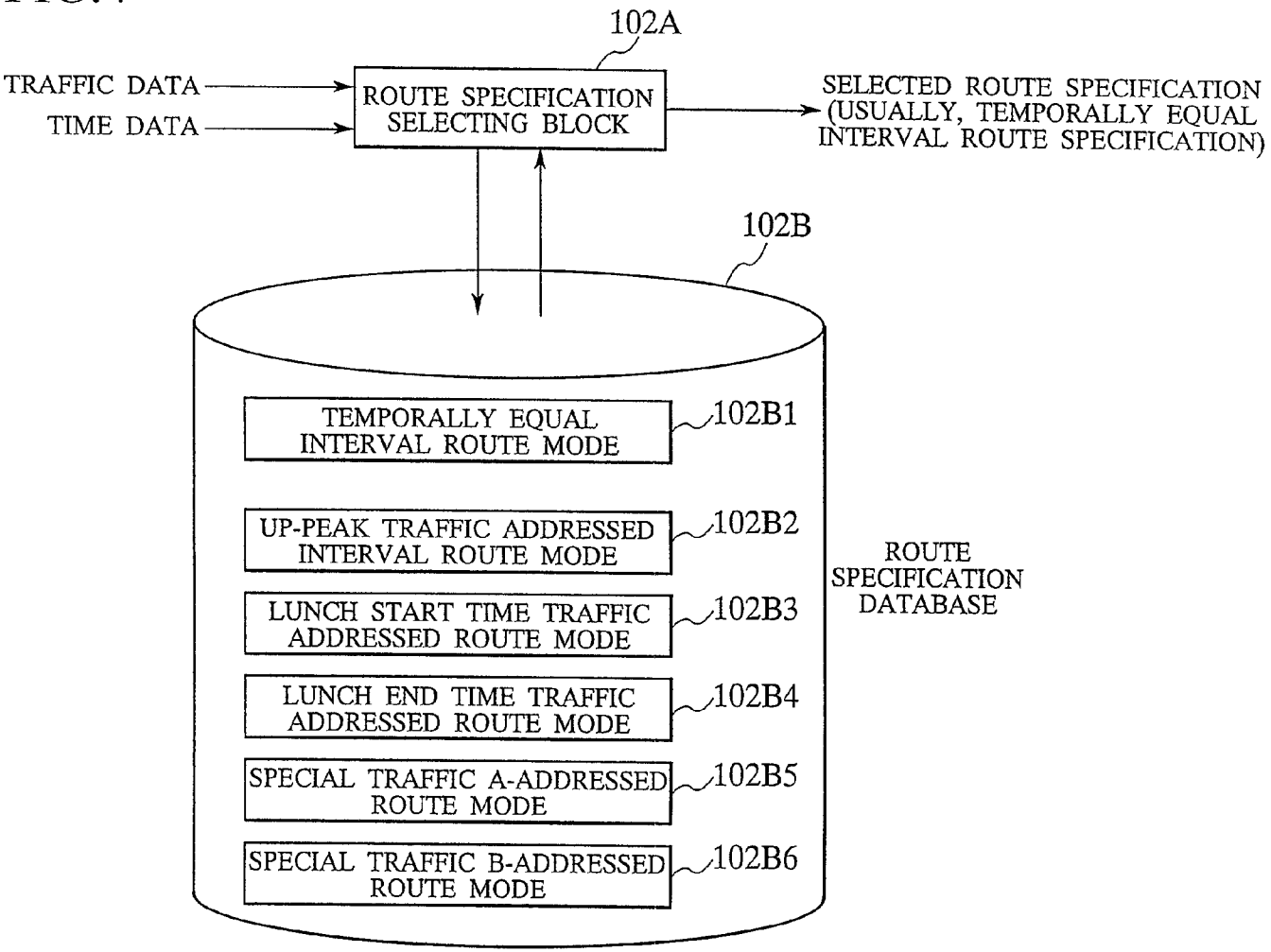
FIG. 4 shows the target route specification setting section 102.

To finalize the detailed description of the control components of FIG. 1, the following describes the target route specification setting section (102 in FIG. 1) in detail with reference to FIG. 4. In FIG. 4, a route specification selecting block 102A, based on the current traffic data and time data, selects the most appropriate route specification from a route specification database 102B. As the route specification to be implemented, this specification is output to the target route preparation section (103 in FIG. 1). In the route specification database 102B, several route specification patterns (hereinafter, denoted as route modes) are stored to cope with different traffic conditions in the building. That is, they may include a temporally equal interval route mode 102B1 as described already, clock-in time-addressed route mode 102B2, lunch start time-addressed route mode 102B3, lunch end time-addressed route mode 102B4, special traffic A-addressed route mode 102B5, and special traffic B-addressed route mode 102B6. The temporally equal interval route mode 102B1 is the most basic mode and its specification intends to put the routes of the respective cars in a temporally equal interval state. Normally, this temporally equal interval route mode is selected. The clock-in time-addressed route mode 102B2 prescribes a specification to cope with the up-peak type of traffic which occurs at the beginning of office hours. Likewise, the lunch start time-addressed route mode 102B3 prescribes a target specification to cope with the down-peak type of traffic which occurs during the first half of the lunch hour while the lunch end time-addressed route mode 102B4 is for the last half of the lunch hour which shows both up-peak and down-peak types of traffic. Further, the special traffic A-addressed route mode 102B5 and special traffic B-addressed route mode 102B6 prescribe target specifications to cope with special types of traffic unique to the building.

The foregoing has described the control configuration and processing of the first embodiment of the present invention (new collective control using target routes) based on FIG. 1. In summary, the following describes what makes the control according to the present invention different from the conventional control with reference to FIGS. 10A and 10B. FIG. 10A illustrates the target route-used control concept of the present invention on an operation diagram. Likewise, FIG. 10B illustrates the conventional control concept on an operation diagram. In the case of the target route-used control in FIG. 10A, since routes which should be taken by the respective cars in the future are determined as target routes, it is possible to control the respective cars by considering their future movements based on the target routes. More specifically, since the target routes are determined so as to put the cars in temporally equal interval state along the time axis, the respective cars can be kept stably in temporally equal interval state, reducing the possibility of long waits (longer than, for example, 1 min) occurring in the future. In the case of the conventional control method, however, evaluation of a car assignment to a newly generated call is basically made based only on the waiting time for which the call is predicted to wait as shown in FIG. 10B. The future situation of the cars is not taken into consideration in this evaluation. Therefore, since the future trajectories of the respective cars cannot be controlled, this method is likely to cause a string-of-cars condition, increasing the possibility of long waits occurring. Although some prior art control method evaluates the future situation of the respective cars, since this evaluation is done at one or plural discrete points of time, continuous control of the future trajectories is not possible, making it difficult to stably keep the cars in temporally equal interval state. Also apparent from comparison between FIG. 10A and FIG. 10B, more information (future target routes and predicted routes drawn continuously along the time axis) is used in FIG. 10A to evaluate the car assignment. As a matter of course, it is therefore possible to implement control by taking into the account the current situation which may widely vary.

Finally, the following provides a supplementary description of characteristics of target routes prepared by the target route preparation method of FIG. 2. As an initial route (also called a pre-adjustment target route) to prepare a target route, a predicted route is applied in the target route preparation method of FIG. 2. As described with FIGS. 5 and 6, this predicted route is prepared by using data which reflect the current traffic situation, namely, average stop frequency data on an each floor/direction basis and average stoppage time data (in addition to data on hall calls already assigned and data on a generated hall call). Therefore, the current traffic situation is reflected in the profile of the predicted route. For example, at the beginning of office hours, since the car stops almost only while the car is ascending (i.e. after the car receives passengers at the first floor, the car stops at each upper floor to unload passengers and goes back to the first floor), the profile of the predicted route has a gentle uphill slope ($\Delta y/\Delta t$ is a positive small value) and a steep downhill slope ($\Delta y/\Delta t$ is a negative large value). Since a target route is prepared by adjusting the grids of this predicted route in the adjustment area, the profile of the target route reflects the traffic situation at that time. For example, at the beginning of office hours, the profile of the target route has a gentle uphill slope and a steep downhill slope, reflecting the traffic situation at the beginning of office hours as well. During the first half of the lunch time and at the end of office hours, the profile of the target route has a steep uphill slope (average stop frequency low) and a gentle downhill slope (average stop frequency high), reflecting the traffic situation at that time. That is, the target route preparation method shown in FIG. 2 can prepare appropriate target routes by reflecting the current traffic situation. In the target route-based control method according to the present invention, the method for preparing target routes as reference routes has a great influence on the control performance. The target route preparation method of FIG. 2, capable of accurately reflecting the traffic situation, is considered very effective.

Figure 16A:
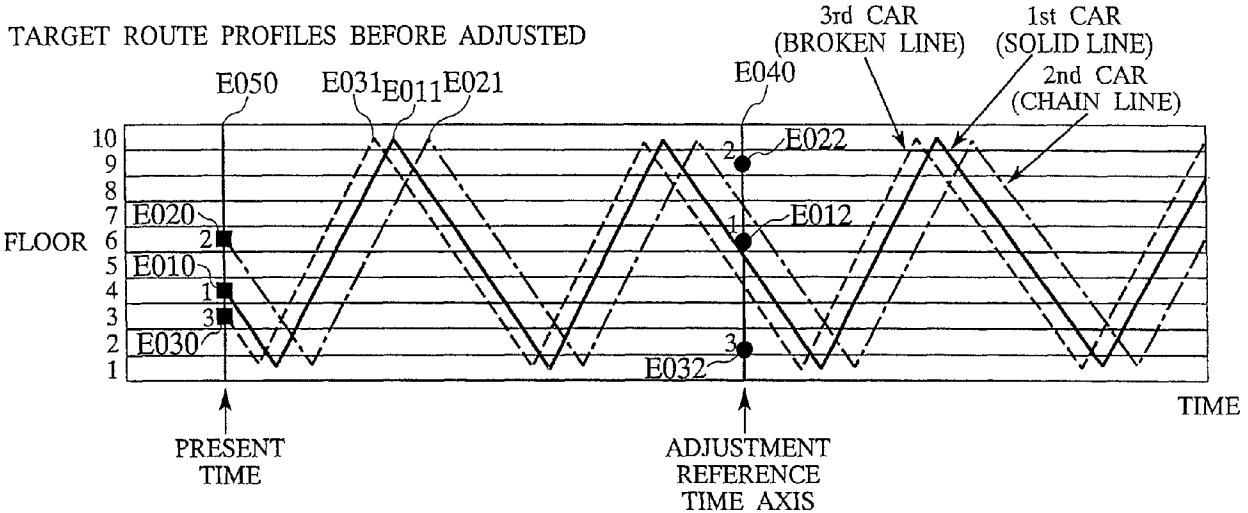
FIGS. 16A and 16B show a first example of target routes prepared in the second embodiment of the present invention.
Figure 16B:
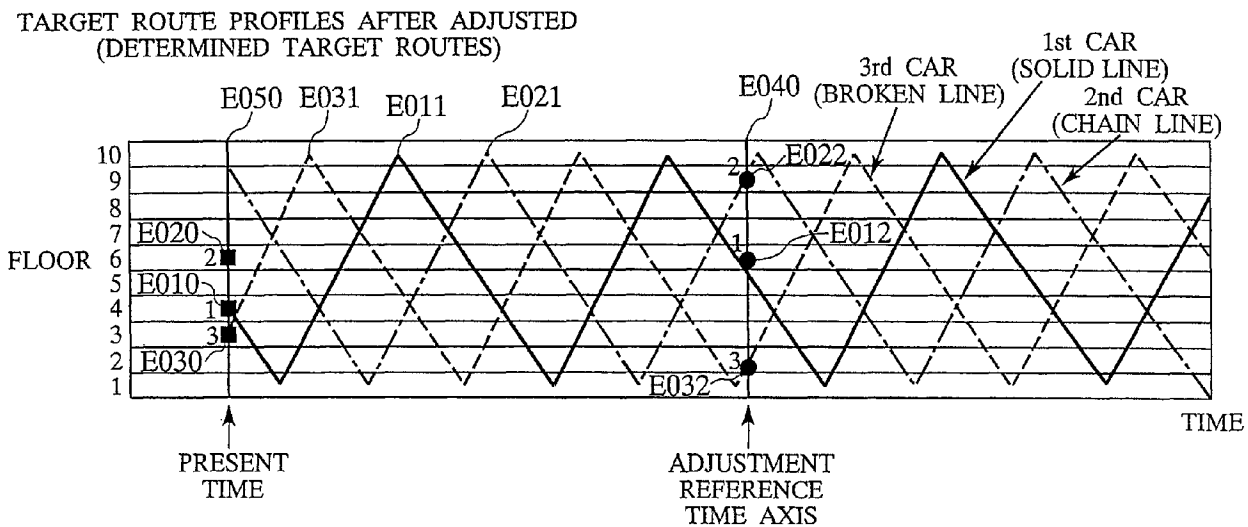

The following describes an elevator group supervisory control system according to a second embodiment of the present invention. The general control configuration of the second embodiment is identical to that of the first embodiment of FIG. 1 except for the target route preparation method implemented by the target route preparation section 103 in FIG. 1. The target route preparation method in the second embodiment is described below with reference to FIGS. 3, 16 and 17. Firstly, refer to FIGS. 16A and 16B where the target route preparation concept of the second embodiment is shown. FIG. 16A shows the profile of a pre-adjustment target route (an initial route to prepare a target route). Like in the first embodiment, a predicted route at that time is used as the pre-adjustment target route. FIG. 16B shows the profile of the target route that is adjusted. The difference between the target route profile by the second embodiment in FIG. 16B and the target route profile by the first embodiment in FIG. 11A appears on the present time axis. In FIG. 11B (first embodiment), each target route is drawn from the current position of the car. In the case of FIG. 16B (second embodiment), each target route is not drawn from the current position of the car. This difference is attributable to their different policies about target routes. In FIG. 11B (first embodiment), the target routes provide transient routes that the cars should take from the current positions in order to settle in temporally equal interval state. On the other hand, in FIG. 16B (second embodiment), the target routes provide routes that the cars should reach. In plain language, the target routes in FIG. 11B (first route) are 'kind' target routes which guide the cars from the current positions into temporally equal interval state. The target routes in FIG. 16B (second embodiment) do not have such a guiding part. Only the final target routes are shown to indicate "anyway follow these routes". These different policies result in different start points (current position and not current position of the car) of each target route.

Figure 17A:
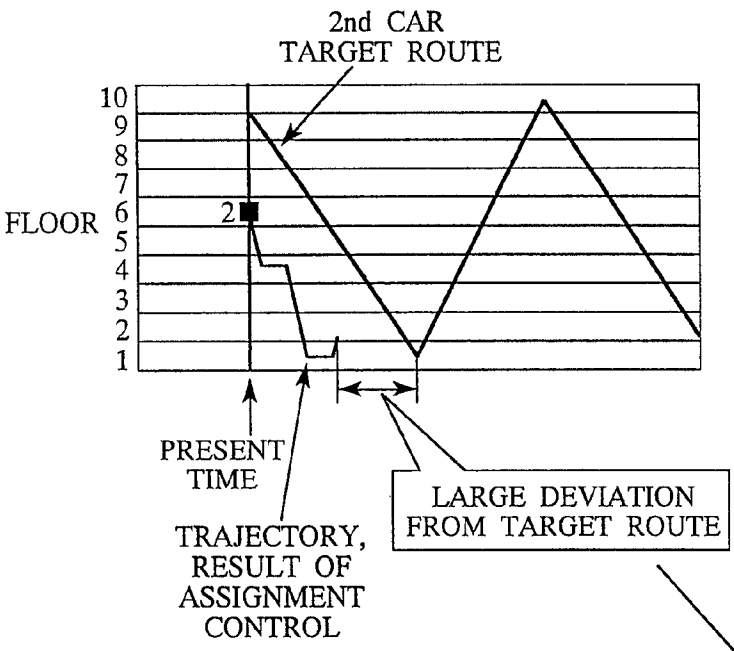
FIGS. 17A and 17B show a second example of target routes prepared in the second embodiment of the present invention.
Figure 17B:
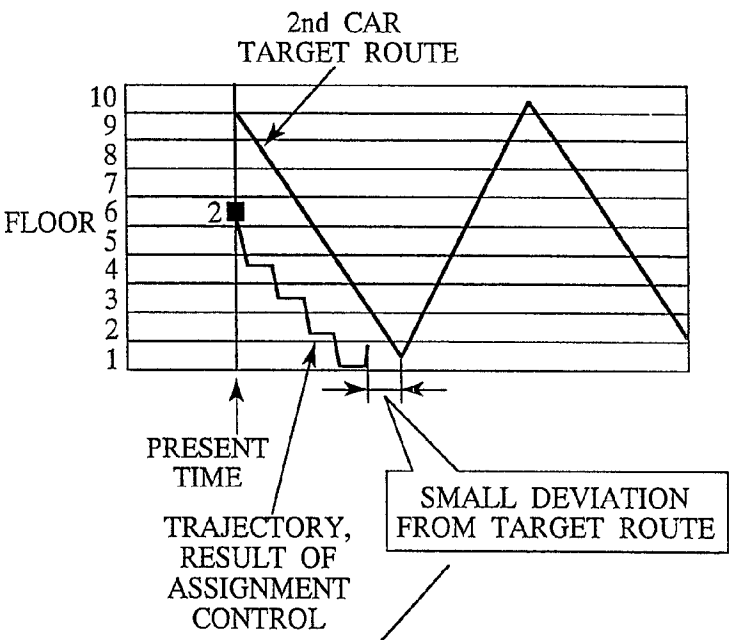

The cars can be controlled so as to follow such target routes as used in the second embodiment. This is described below with reference to FIGS. 17A and 17B. FIGS. 17A and 17B show a target route and the subsequent actual trajectory of the car. In FIG. 17A, the subsequent actual trajectory of the car indicates that the car is not assigned many times, namely, not stopped many times. In the case of FIG. 17B, the car is assigned many times and therefore stopped many times. Apparent from comparison between FIG. 17A and FIG. 17B, the deviation of the actual trajectory from the target route is smaller in FIG. 17B. As described earlier, assignment control according to the present invention selects such a car as to make the deviation (inter-route distance) of its predicted route from the target route. Therefore, control should be done so as to assign many calls to this car (2nd car assumed) in FIG. 17B. Consequently, the actual routes follow the target routes. That is, the cars can be controlled so as to follow such target routes as prepared in the second embodiment.

Figure 3:
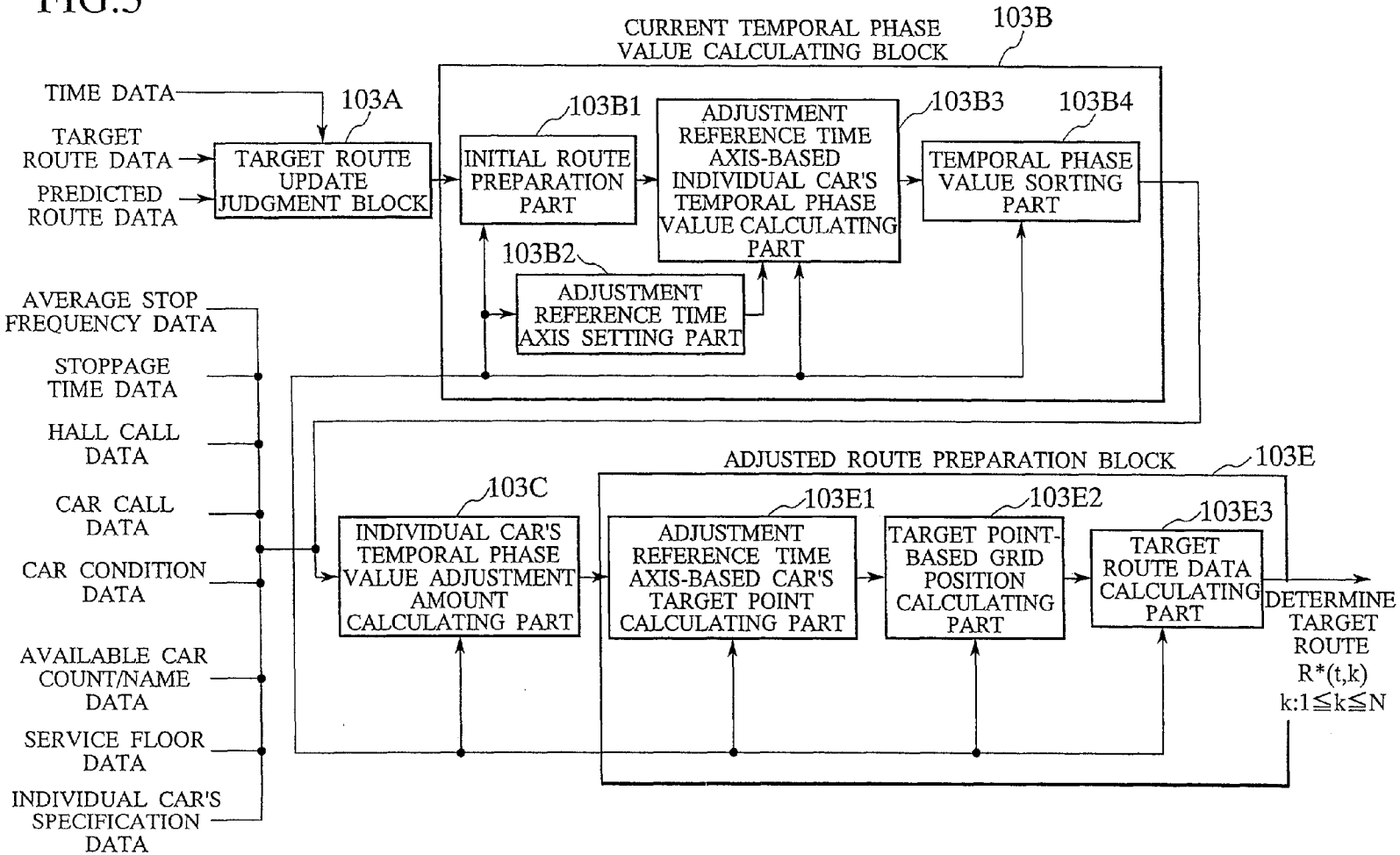
FIG. 3 shows the control configuration of a target route preparation section in a second embodiment of the present invention.

The control configuration of the target route preparation section in the second embodiment described above is illustrated in FIG. 3 in detail. In FIG. 3, the components identical to those in FIG. 2 (the target route preparation section in the first embodiment) are given common reference numerals and not described here. That is, a target route update judgment block 103A, current temporal phase value calculating block 103B and individual car's temporal phase value adjustment amount calculating block 103C in FIG. 3 are identical in processing to those in FIG. 2 (first embodiment). An adjusted route preparation block 103E is unique. In the adjusted route preparation block 103E: 1) target points on the adjustment reference time axis are calculated by an each car's target point calculating part 103E1; 2) target route grids are calculated by a target point-based grid position calculating part 103E2; 3) grids are connected by a target route data calculating part 103E3 to calculate target route data. The following provides a detailed description of how this adjusted route preparation block 103E operates. Firstly, a target point on the adjustment reference axis is calculated in the each car's target point calculating part 103E1 for each car by using the temporal phase adjustment value Δtp(k) (k means the k-th car) calculated by the individual car's temporal phase value adjustment amount calculating block 103C. Using tp(k) to denote the pre-adjustment temporal phase value (the adjustment reference time axis-based temporal phase of the pre-adjustment route), the adjusted temporal phase value tp_N(k) is given by the following equation.

$$tp_N(k)=tp(k)+\Delta tp(k) \tag{20}$$

The adjusted temporal phase value tp_N(k) plotted on the adjustment reference axis (along the floor position axis) becomes the target point of the car. Symbol y_N(k), the target point position of a car, can be given by the following equation (see FIG. 15).

When the car is ascending, $$y_N(k)=(y_\max/T\pi)\times tp_N(k) \tag{21}$$

When the car is descending, $$y_N(k)=-(y_\max/(T-T\pi)\times(tp_N(k)-T) \tag{22}$$

In FIG. 16A where pre-adjustment target route profiles are shown, the target points of the respective cars are points E012 (first car), E022 (second car) and E032 (third car). Based on these target points, the pre-adjustment target routes (or predicted routes) E011, E021 and E031 of the respective cars are translated so that they go through their respective target points, thus calculating the adjusted target routes (routes in FIG. 16B). This translating calculation is done by the target point-based grid position calculating part 103E2 in FIG. 3. Using gp(k, i) (k: number of the car, i: number of the grid) to denote the temporal position of a grid of the pre-adjustment target route of a car, the temporal position of the adjusted target route of the car gp_N(k, i) is given by the following equation.

$$gp_N(k, i)=gp(k, i)+tp_N(k) \tag{23}$$

Equation (23) means to translate all grids of the k-th car by adjustment amount tp_N(k). In the target route calculating part predicted route preparation section 103E3, target route data is calculated by connecting these adjusted grids according to their temporal positions gp_N(k, i). Consequently, the pre-adjustment target routes (E011, E021 and E031 in FIG. 16A) are converted to adjusted target routes (E011, E021 and E031 in FIG. 16B which come at temporally equal intervals. It can be verified in FIG. 16B that the adjusted target routes go through their respective target points E012, E022 and E032 on the adjustment reference axis (E040 in FIG. 16B) as intended. Note that as understood from the foregoing description, the target points themselves do not directly relate to the adjusted target route calculating process. Accordingly, the adjusted target routes (E011, E021 and E031 in FIG. 16B) can be obtained even if the each car's target point calculating part 103E1 is removed from the adjusted route preparation block 103E. The target points themselves are used for operation check, etc. Also note that referring to FIG. 16B although the target route profiles are completely in temporally equal interval state in the adjustment area between the present time axis (E050) and the adjustment reference time axis (E040), they are simplified on the assumption that there is no hall/car call which is already assigned. If hall/car calls are already assigned, the target routes are not always in temporally equal interval state in the adjustment area since the stop calls are not evenly distributed among the cars.

Although control by the aforementioned embodiments intends to put the respective cars in temporally equal interval condition, the present invention is not limited to the control for temporally equal interval condition. According to the present invention, it is possible to run elevators according to a specific purpose only by determining the target routes in consistence with the purpose. If the target routes of the respective elevators are determined by taking, for example, energy saving into consideration, it is possible to realize energy-saved elevator group supervisory control.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. An elevator group control system for controlling multiple elevators cars each of which serves a plurality of floors, comprising:

a route preparation section which, at a time of assigning a hall call to one of the elevator cars, calculates, as a future trajectory, an operation diagram for each of the elevator cars with a horizontal axis representing time and a vertical axis representing vertical positions of respective floors in the building, for a case in which the hall call is assigned to each of the elevator cars; and a selecting unit which determines a selected one of the elevator cars to which the hall call is to be assigned using the calculated future trajectories.

2. The elevator group control system according to claim 1, wherein the future trajectories are calculated using service floor information at a current time or a current time period.

3. The elevator group control system according to claim 1, wherein the route preparation section calculates the future trajectory for each elevator car using estimated times of arrival at the respective floors for the respective elevator car, wherein these estimated times of arrival at the respective floors as to each of the elevator cars respectively indicate predicted floor positions of each elevator car at given future times, and wherein the future trajectory for each elevator car corresponds to a route prepared by connecting a plurality of points, wherein coordinates of each point are a floor position and the estimated time of arrival of the respective elevator car at the respective floor position.

4. The elevator group control system according to claim 1, wherein the future trajectory is calculated using traffic information and information relating to states of the elevator cars.

5. An elevator group control system for controlling multiple elevators cars each of which serves a plurality of floors, comprising:

a route preparation section which, at a time of assigning a hall call to one of the elevator cars, calculates a future trajectory for each of the elevator cars for a case in which the hall call is assigned to each of the elevator cars; and a selecting unit which determines a selected one of the elevator cars to which the hall call is to be assigned using the calculated future trajectories, wherein the selected one of the elevator cars is determined using an evaluation value for each elevator car, wherein the evaluation value is based on one of a time for which a hall call is predicted to wait if assigned to the respective elevator car, and a maximum of the predicted times to wait for all hall calls already assigned to the respective elevator car.

* * * * *